US011280085B2

(12) United States Patent
Buffington et al.

(10) Patent No.: US 11,280,085 B2
(45) Date of Patent: Mar. 22, 2022

(54) INTERLOCKING PANELS

(71) Applicants: Dean Buffington, Denver, CO (US); Donna Buffington, Denver, CO (US)

(72) Inventors: Dean Buffington, Denver, CO (US); Donna Buffington, Denver, CO (US)

( * ) Notice: Subject to any disclaimer, the term of this patent is extended or adjusted under 35 U.S.C. 154(b) by 317 days.

(21) Appl. No.: 15/960,239

(22) Filed: Apr. 23, 2018

(65) Prior Publication Data

US 2018/0305924 A1 Oct. 25, 2018

Related U.S. Application Data

(60) Provisional application No. 62/488,240, filed on Apr. 21, 2017.

(51) Int. Cl.

| | |
|---|---|
| ***E04C 2/08*** | (2006.01) |
| ***E04B 2/74*** | (2006.01) |
| ***E04C 2/52*** | (2006.01) |
| ***E04C 2/20*** | (2006.01) |
| ***E04C 2/12*** | (2006.01) |

(Continued)

(52) U.S. Cl.

CPC ..... *E04B 2/7427* (2013.01); *E04B 2/7405* (2013.01); *E04C 2/08* (2013.01); *E04C 2/12* (2013.01); *E04C 2/20* (2013.01); *E04C 2/405* (2013.01); *E04C 2/46* (2013.01); *E04C 2/52* (2013.01); *A47G 5/00* (2013.01); *A47G 2200/106* (2013.01); *E04B 1/6116* (2013.01); *E04B 1/6137* (2013.01); *E04B 1/6162* (2013.01); *E04B 1/6179* (2013.01); *E04B 2001/6195* (2013.01); *E04B 2002/7487* (2013.01); *E04G 21/3204* (2013.01); *E04G 21/3233* (2013.01)

(58) Field of Classification Search

CPC .... E04B 2/7427; E04B 2/7405; E04B 1/6162; E04B 1/6116; E04B 1/6137; E04B 1/6179; E04B 2002/7487; E04B 1/6158; E04C 2002/004; E04C 2/20; E04C 2/52; A47B 47/0075; A47B 2230/0096; A47B 47/047; A47B 47/042; F16B 5/0044; F16B 5/0036; F24C 15/12

See application file for complete search history.

(56) References Cited

U.S. PATENT DOCUMENTS 263,914 A * 9/1882 Kern ..... E04F 15/04 52/592.1
1,071,330 A * 8/1913 McDonough ..... E04F 15/04 52/592.1

(Continued)

OTHER PUBLICATIONS

Norpro Non-Stick Splatter Guard 2063, Norpro Webstore, [retrieved on Apr. 9, 2018], Retrieved from: https://www.norprowebstore.com/norpro-non-stick-splatter-guard-2063.html.

(Continued)

*Primary Examiner* — Daniel P Cahn
*Assistant Examiner* — Abe Massad
(74) *Attorney, Agent, or Firm* — Holzer Patel Drennan

(57) ABSTRACT

The disclosed interlocking panel systems are portable, self-supporting, and modular. They may function as guards around the sides, rear, and a surface of a workspace and can be disassembled by one person and transported to a sink for cleaning or another location for use or storage. They may also function as structural panels for constructing an enclosure, such as a building.

16 Claims, 22 Drawing Sheets

(51) Int. Cl.

| | |
|---|---|
| ***E04B 2/00*** | (2006.01) |
| ***E04C 2/40*** | (2006.01) |
| *E04B 1/61* | (2006.01) |
| *A47G 5/00* | (2006.01) |
| *E04G 21/32* | (2006.01) |

(56) References Cited

U.S. PATENT DOCUMENTS 2,279,864 A * 4/1942 Eide ..... A47B 47/042 211/189
2,302,962 A * 11/1942 Laucks ..... E04C 2/12 52/481.1
2,441,364 A * 5/1948 Maynard ..... E04B 2/04 52/583.1
3,368,856 A * 2/1968 Tisdall ..... A47B 87/02 312/111
3,513,826 A * 5/1970 Hellmuth ..... F24C 15/36 126/211
3,602,275 A * 8/1971 Nissen ..... B27M 3/002 144/4.1
3,614,446 A * 10/1971 Leuthold ..... E04B 2/08 250/517.1
4,009,665 A * 3/1977 Weisheit ..... A47B 47/0025 108/60
4,395,955 A * 8/1983 Pfeifer ..... A47F 5/005 108/61
4,562,776 A * 1/1986 Miranda ..... A47B 47/042 108/158.12
4,595,105 A * 6/1986 Gold ..... A47B 65/00 108/60
5,215,490 A * 6/1993 Szoradi ..... A63H 33/08 446/115
5,382,087 A * 1/1995 Pouch ..... A47B 43/00 160/135
5,546,720 A * 8/1996 LaBruzza ..... E04B 1/6179 52/586.2
6,247,286 B1 * 6/2001 Heyns ..... E04C 2/296 52/589.1
6,453,973 B1 * 9/2002 Russo ..... A47B 47/0075 160/135
6,675,979 B2 * 1/2004 Taylor ..... A47B 47/042 108/153.1
6,866,035 B2 * 3/2005 Haemerle ..... F24C 15/12 126/214 D
6,973,927 B1 * 12/2005 Stewart ..... A47J 37/0786 126/201
7,150,135 B2 * 12/2006 Becker ..... E04F 13/0878 52/592.1
7,155,865 B2 * 1/2007 Rosenberg ..... E04B 1/12 52/79.9
8,316,606 B2 * 11/2012 Siewert ..... E04F 13/10 52/483.1
8,590,976 B2 * 11/2013 Davis ..... A47B 47/0075 297/440.1
10,159,338 B2 * 12/2018 Wobser ..... A47B 47/042
2003/0056907 A1 * 3/2003 Caveney ..... A63B 69/0097 160/135
2010/0093257 A1 * 4/2010 Elliott ..... A47C 4/03 446/478
2011/0163287 A1 * 7/2011 Massameno ..... E01F 13/02 256/19
2018/0065272 A1 * 3/2018 Saylor ..... B27C 5/10
2020/0124292 A1 * 4/2020 Haemerle ..... F24C 15/12

OTHER PUBLICATIONS

3 Sided Spatter Shield Guard, Miles Kimball, [retrieved on Apr. 9, 2018], Retrieved from: https://www.amazon.com/dp/B008E06YYE/ref=sxbs_sxwds-stvp_1?pf_rd_m=ATVPDKIKX0DER&pf_rd_p=3524794222&pd_rd_wg=3W0jE&pf_rd_r=8MC8B6TD6PCMPG2N7W42&pf_rd_s=desktop-sx-bottom-slot&pf_rd_t=301&pd_rd_i=B008E06YYE&pd_rd_w=UVE9I&pf_rd_i=splash+guard&pd_rd_r=1e198d76-d266-4c60-97e8-4d236f395987&ie=UTF8&qid=1521759857&sr=1.

* cited by examiner

INTERLOCKING PANELS

CROSS-REFERENCE TO RELATED APPLICATIONS

The present application claims benefit of priority to U.S. Provisional Patent Application No. 62/488,240, entitled "Portable Workspace Barrier" and filed on Apr. 21, 2017, which is specifically incorporated by reference herein for all that it discloses or teaches.

BACKGROUND

Structural panels may be used to construct a variety of enclosures, including but not limited to shelters, buildings, enclosures, and divider walls. While many different types of connections are used to assemble a series of structural panels, many of these connections suffer from an inability to readily disassemble, failure to maintain an adequate strength in resisting movement in one or more directions, and difficulty in creating or maintaining a proper connection between panels, for example.

A series of panels may also be used to create a partial enclosure for food preparation or other activities. In activities where cross-contamination of materials or working surfaces is a liability, such barriers that contain contaminates may be beneficial. Prior enclosure solutions are often built-in-place solutions. They may include washable panels mounted to walls surrounding a work surface, sometimes in combination with permanently mounted dividers. Other prior enclosure solutions may rely on low profile backsplashes built into associated work tables. These options do not offer versatility for configuring different contained workspaces. Further, prior enclosure solutions are often difficult to clean and sanitize.

SUMMARY

Implementations described herein provide an interlocking panel system comprising a first panel including a first finger joint occupying an edge surface of the first panel and a second panel including a second finger joint occupying an edge surface of the second panel. The first finger joint and the second finger joint each have an interlocking plan and an interlocking profile. The first panel is slidably connectable to the second panel by interfacing the first finger joint with the second finger joint.

Implementations described herein further provide a workspace barrier comprising a left-rear panel, a right-rear panel, a left panel, and a right panel. The left-rear panel includes a first finger joint occupying an edge surface of the left-rear panel, the first finger joint having an interlocking plan and an interlocking profile. The right-rear panel includes a second finger joint occupying an edge surface of the right-rear panel, the second finger joint also having an interlocking plan and an interlocking profile. The first panel is slidably connectable to the second panel by interfacing the first finger joint with the second finger joint. The left panel is selectively interlocked with the left-rear panel and extends in a different plane from the left-rear panel and the right-rear panel when assembled. The right panel is selectively interlocked with the right-rear panel and extends in another different plane from the left-rear panel and the right-rear panel when assembled.

Implementations described herein still further provide a method of assembling a workspace barrier. The method includes selectively interlocking a left-rear panel including a first finger joint occupying an edge surface of the left-rear panel to a right-rear panel including a second finger joint occupying an edge surface of the right-rear panel. Each of the first finger joint and the second finger joint has an interlocking plan and an interlocking profile. The first panel is slidably connectable to the second panel by interfacing the first finger joint with the second finger joint. The method further includes selectively interlocking a left panel to the left-rear panel, the left panel extending in a different plane from the left-rear panel and the right-rear panel. The method further includes selectively interlocking a right panel to the right-rear panel, the right panel extending in a different plane from the left-rear panel and the right-rear panel. The method further includes positioning the interlocked workspace barrier in a self-supporting vertical orientation upon a workspace.

Implementations described herein further still provide an interlocking panel system that may function as a shield, guard, and/or containment around the sides of a workspace. The interlocking panel system may include three or more interlocking panel pieces, a left panel, a rear panel, and a right panel arranged in a self-supporting manner. In some implementations, there may be additional panels to lend additional modularity or portability to the interlocking panel system, or serve as a work surface (i.e., a bottom panel).

Once disassembled, the interlocking panel system panels may be light and small enough for a person to hand carry. In some implementations, a slot is cut out of the top of each panel to provide a built-in handle for carrying the panel. This allows for the individual panels to be transported to a sink for cleaning and disinfecting or to another location for use or storage. The various joinery linking the individual panels is designed to make the interlocking panel system easy to construct and deconstruct quickly and without special tools. The joinery is further designed to minimize the collection of contaminates, allowing for the interlocking panel system panels to be easily cleaned and sanitized.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims.

BRIEF DESCRIPTIONS OF THE DRAWINGS

The following figures may include example dimensions, combinations of joinery, thickness of material, specifications for hardware, specific shapes of profiles, for example. Any or none of which may be included unless explicitly claimed otherwise or inherently necessitated by the claim language.

DETAILED DESCRIPTION

The portable workspace barriers disclosed herein may function variously as a shield, guard, and/or containment around the sides of a workspace that can be easily assembled and disassembled without the use of tools. In various implementations, the portable workspace barriers include four interlocking panels, a left panel, two rear panels, and a right panel. In some implementations there may be additional left, rear, or right panels to lengthen or deepen the portable workspace barrier or provide modularity to the portable workspace barrier size. In still other implementations, the portable workspace barriers include a bottom panel that forms a work surface. While many of the example implementations provided herein are described in detail as portable workspace barriers, similar features may be included in other products, such as structural panels and other types of interlocking panels.

In an example implementation, the interlocking panel systems described in detail herein are constructed of ½" thick high-density polyethylene (HDPE), polypropylene, or other plastic materials that are strong, rigid, stable, durable, and moisture resistant. In other implementations, the interlocking panel systems can be constructed of closed cell foams or solid plastics, various metal alloys, or natural materials (e.g., wood). The interlocking panel systems may also include additional rubberized features that give the individual panels a nonslip characteristic. The interlocking panel system material may also include anti-microbial and/or fire-resistant characteristics.

The thickness of the interlocking panel system may vary depending on desired rigidity considering the material used for construction and overall size of the interlocking panel system. In various implementations, the material thickness may vary from ⅛" to 2". The interlocking panel system may be of any overall size that makes it functional for its intended task. In an example implementation, the interlocking panel system is 24 or more inches wide, 18 or more inches deep and 16 or more inches tall. Further, the interlocking panel system may be made of up individual panels of various sizes and shapes. For example, the individual panels may be generally rectangular, square, trapezoidal, or have other shapes or combinations of shapes.

Figure 1:
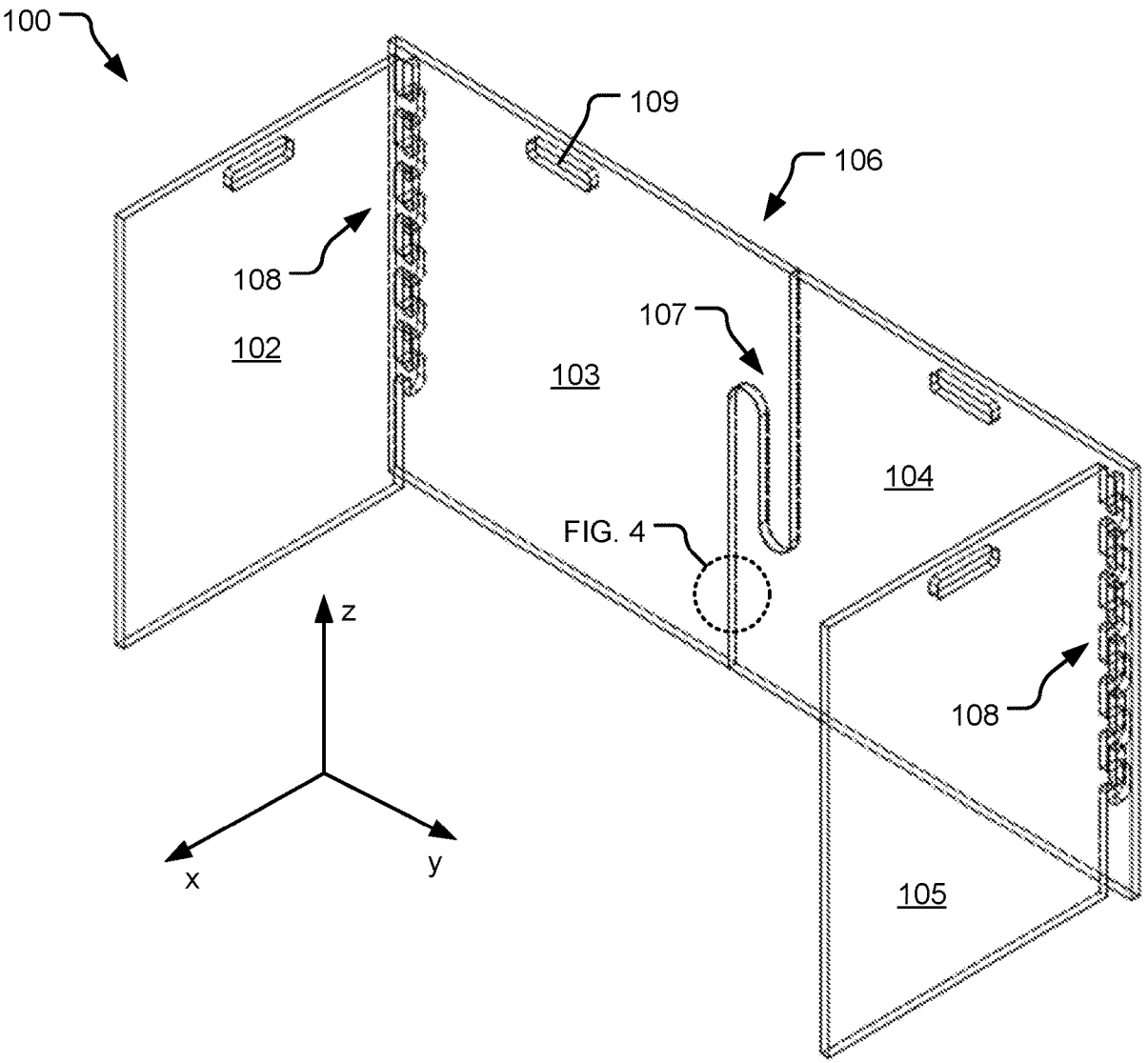
FIG. 1 is a perspective view of an example assembled 4-panel interlocking panel system.

FIG. 1 is a perspective view of an example assembled 4-panel interlocking panel system 100. The system 100 includes four individual separable panels, a left panel 102, a left-rear panel 103, a right-rear panel 104, and a right panel 105. The left-rear panel 103 and the right-rear panel 104 are selectively joined together at interlocking finger joint 107 to form a rear wall 106. The left panel 102 is attached to the left-rear panel 103 and the right panel 105 is attached to the right-rear panel 104 at D-tab and slot corner joints 108, which renders the system 100 self-supporting without the use of any separate fasteners.

The finger joint 107 includes an interlocking plan and an interlocking profile (each described in further detail below with reference to FIGS. 3-5) occupying interfacing edge surfaces of each of the rear panels 103, 104. The finger joint 107 provides both lateral (x-axis) and longitudinal (y-axis) stability, as well vertical (z-axis) stability through the weight of the left-rear panel 103, thereby rendering the back wall 106 substantially rigid and secure in all directions. The left panel 102 and the right panel 105 adjoin the rear wall 106, each extending from the rear wall 106 in a different plane oriented at substantially a 90° angle from the rear wall 106. The respective D-tab and slot joints 108 to form the corners of the system 100. During assembly, the side panels 102, 105 are each lifted (e.g., approximately 1" or less) to align D-tabs with their respective slots, the D-tabs are inserted into their respective slots, and the side panels 102, 105 are released to interlock the D-tabs with the slots by force of gravity. The weight of the side panels 102, 105 maintains the connection at the D-tab and slot joints 108. Carrying handles (e.g., slot 109) are cut out of the top of each of the panels 102, 103, 104, 105 to aid in transporting the panels 102, 103, 104, 105 individually, or as a disassembled stack.

The width (i.e., overall dimension along the y-axis), depth (i.e., overall dimension along the x-axis), and height (i.e., overall dimension along the z-axis) of the system 100 may vary widely. For example, the width may be 24" to 72", the depth may be 20" to 32", and the height may be 16" to 48".

Figure 2:
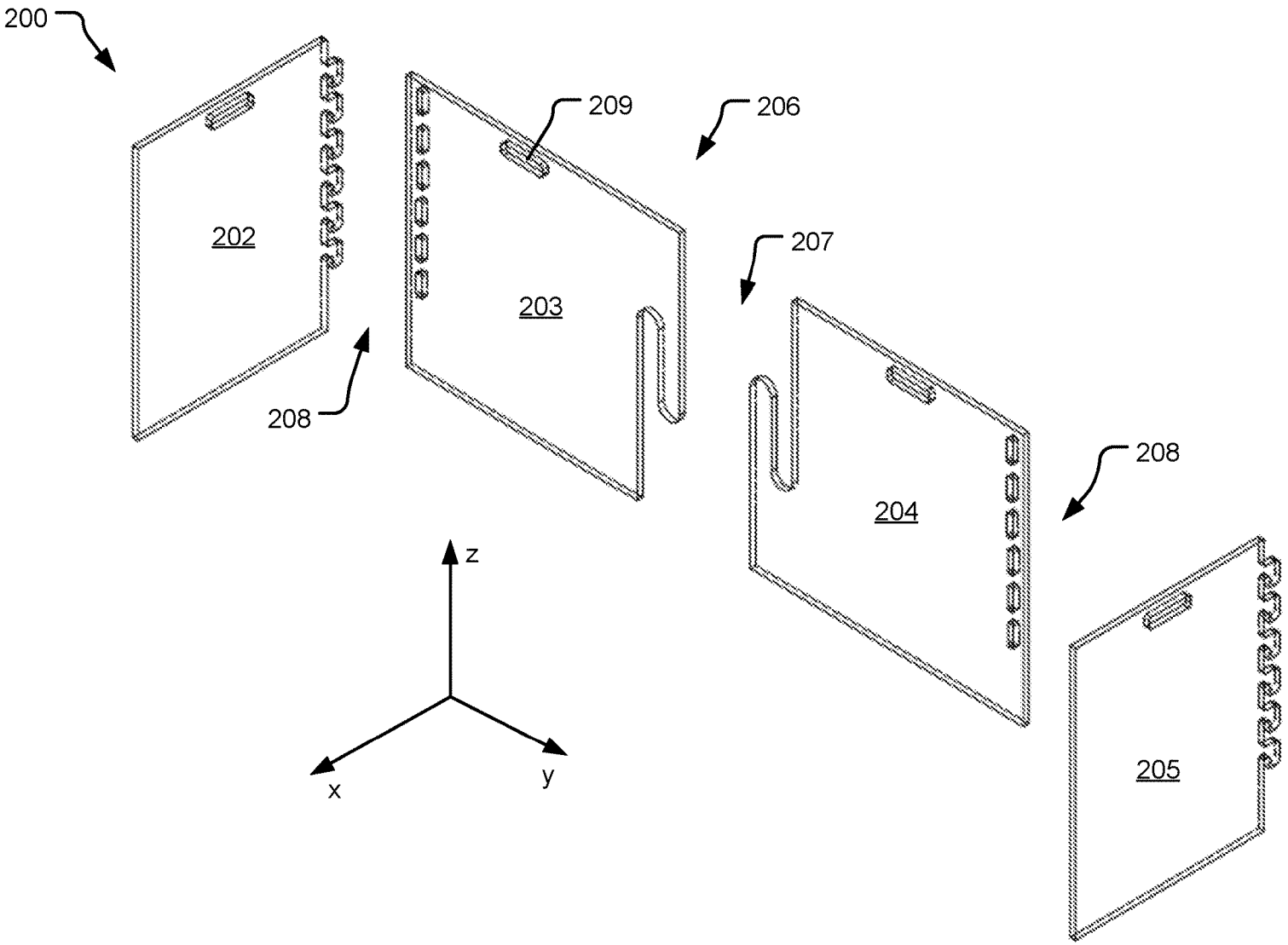
FIG. 2 is a perspective view of an example disassembled 4-panel interlocking panel system.

FIG. 2 is a perspective view of an example disassembled 4-panel interlocking panel system 200. The system 200 includes four individual separable panels, a left panel 202, a left-rear panel 203, a right-rear panel 204, and a right panel 205. The left-rear panel 203 and the right-rear panel 204 are selectively joined together at interlocking finger joint 207 to form a rear wall 206. The left panel 202 is attached to the left-rear panel 203 and the right panel 205 is attached to the right-rear panel 204 at D-tab and slot corner joints 208, which renders the system 200 self-supporting without the use of any separate fasteners.

The finger joint 207 includes an interlocking plan and an interlocking profile (each described in further detail below with reference to FIGS. 3-5) occupying interfacing edge surfaces of each of the rear panels 203, 204. The finger joint 207 provides both lateral (x-axis) and longitudinal (y-axis) stability, as well vertical (z-axis) stability through the weight of the left-rear panel 203, thereby rendering the back wall 206 substantially rigid and secure in all directions. The left panel 202 and the right panel 205 adjoin the rear wall 206, each at substantially a 90° angle with respective D-tab and slot joints 208 to form the corners of the system 200. During assembly, the side panels 202, 205 are each lifted (e.g., approximately 1" or less) to align D-tabs with their respective slots, the D-tabs are inserted into their respective slots, and the side panels 202, 205 are released to interlock the D-tabs with the slots by force of gravity. The weight of the side panels 202, 205 maintains the connection at the D-tab and slot joints 208. Carrying handles (e.g., slot 209) are cut out of the top of each of the panels 202, 203, 204, 205 to aid in transporting the panels 202, 203, 204, 205 individually, or as a disassembled stack.

Figure 3:
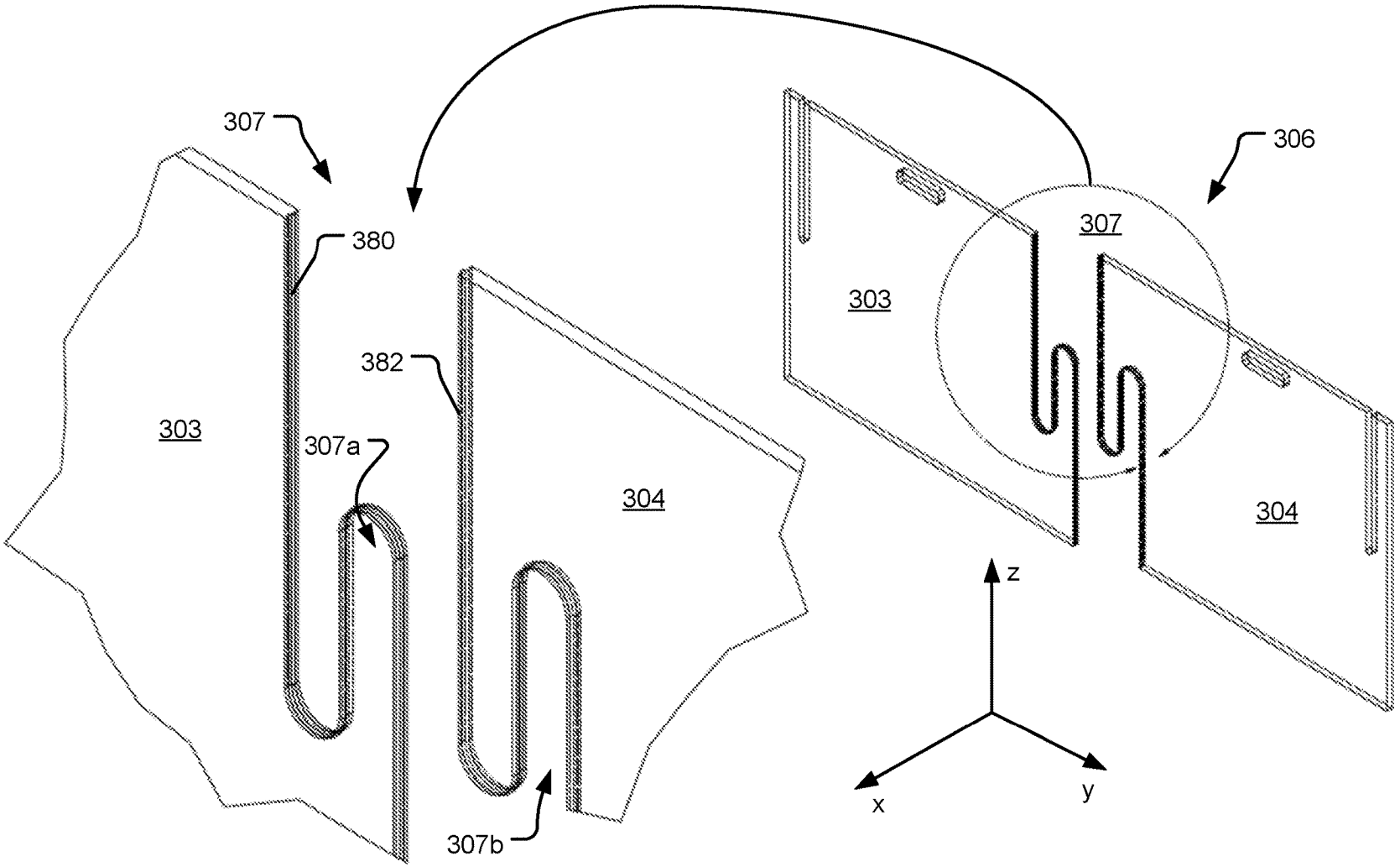
FIG. 3 is an exploded detail view of an example interlocking finger joint for a back wall of an interlocking panel system.

FIG. 3 is an exploded detail view of an example interlocking finger joint 307 for a back wall 306 of an interlocking panel system. The finger joint 307 includes an interlocking plan, here, a s-shaped plan in the y-z plane in each of panels 303, 304 occupying interfacing edge surfaces 380, 382. During assembly, the panels 303, 304 are aligned in the y-z plane and the respective interlocking plans of the panels 303, 304 are aligned in the z-direction and interlocked by moving the panels 303, 304 toward one another in the z-direction. Once assembled, the interlocking plan secures the panels 303, 304 from movement in relation to one another in the y-direction, as well as limits movement in the z-direction.

The s-shaped plan may vary in size and shape from that depicted in FIG. 3 and may occupy a portion of or the entirety of the interfacing edge surfaces 380, 382. In other implementations, the interlocking plan may have a variety of other shapes (e.g., a saw-tooth plan, a square-wave plane, etc.) that lock the panels 303, 304 together. In various implementations, the interlocking plan in the y-z plane in each of panels 303, 304 includes at least three parallel edge surfaces.

The finger joint 307 also includes an interlocking profile (described in further detail below with reference to FIGS. 4-5) occupying the interfacing edge surfaces 380, 382 of each of the panels 303, 304. The interlocking plan and the interlocking profile of the finger joint 307 in combination provides both lateral (x-axis) and longitudinal (y-axis) stability, as well vertical (z-axis) stability through the weight of the panel 303, thereby rendering the back wall 306 substantially rigid and secure in all directions when assembled.

The interlocking finger joint 307 provides stability to longitudinal strain along the y-axis of the back wall 306. The depicted rounded-end configuration of the interlocking finger joint 307 helps the matched panels 303, 304 self-center when being joined, easing the action of aligning the interlocking finger joint 307 and sliding the panels 303, 304 together along the vertical z-axis. The interlocking finger joint 307 is cut laterally in the panels 303, 304 perpendicular to a face of each panel (in the y-z plane) in a configuration that includes a finger-shaped tab 307*a* in each of the panels 303, 304, to fit into a corresponding finger-shaped void 307*b* in the other of the panels 303, 304. The interlocking finger-shaped tabs 307*a* and the finger-shaped voids 307*b* keep the panels 303, 304 joined end-to-end under strain in the y-direction. To provide coplanar alignment and stability to lateral strain along the x-axis of the back wall 306, the edge surfaces 380, 382 of the interlocking finger joint 307 are routed with a s-shaped tenon and groove, as described in further detail below with reference to FIGS. 4-5).

In some implementations, the finger-shaped voids may increase in size in a direction away from their openings to provide a biased locking characteristic when the back wall 306 is assembled. Further, the interlocking finger joint 307 may create a splash-tight seal when assembled.

Figure 4:
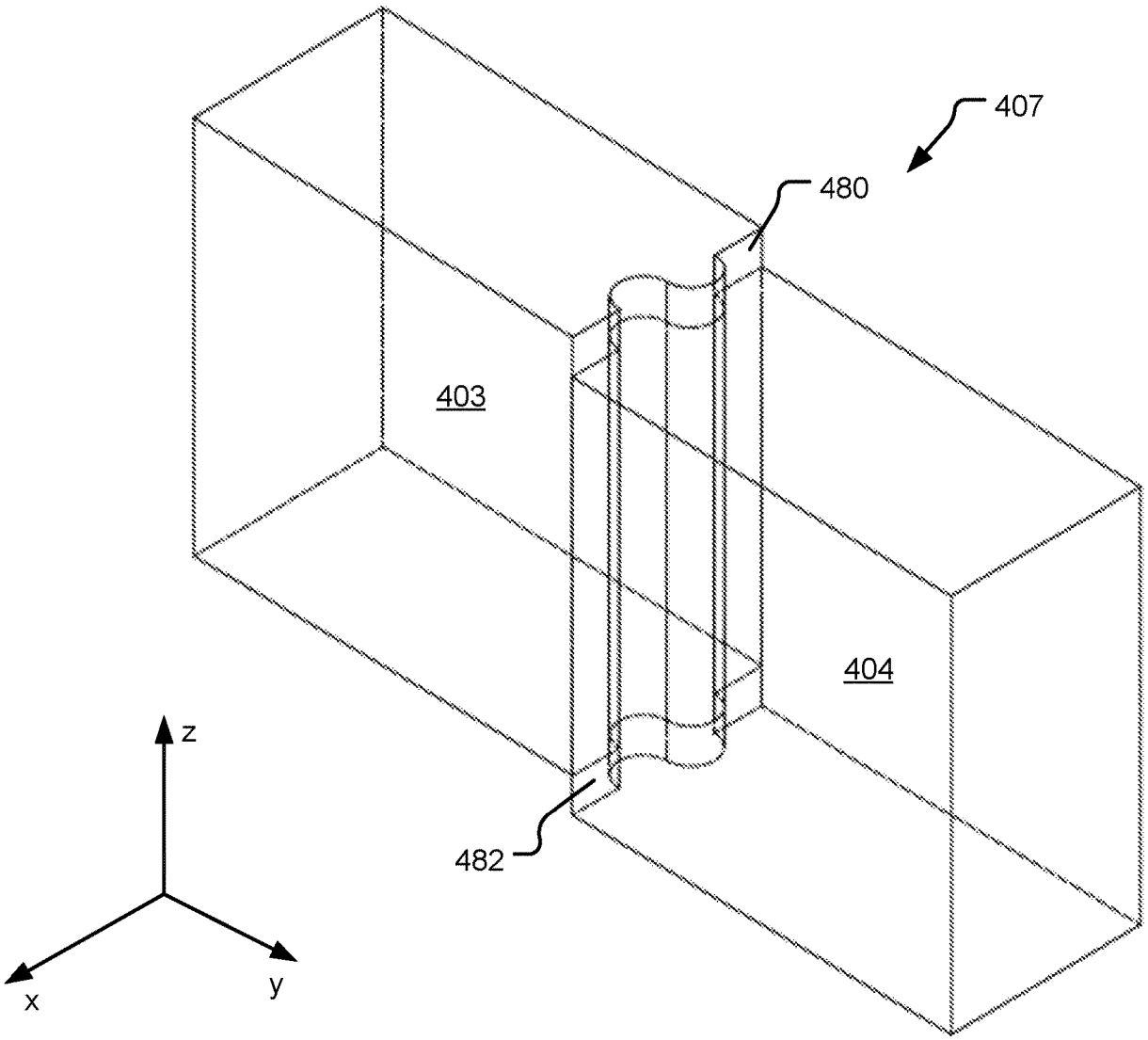
FIG. 4 is a detail view of an s-shaped tenon and groove profile of an example interlocking finger joint.

FIG. 4 is a detail view of an s-shaped tenon and groove profile of an example interlocking finger joint 407. The s-shaped tenon and groove interlocking profile is formed in matching edge surfaces 480, 482 and may be cut along the entire edge surfaces 480, 482 (see e.g., FIGS. 1-3) to provide lateral stability and strength for the finger joint 407. The edge surfaces 480, 482 may be machined with a custom-made router bit that creates two matching interlocking profiles for interlocking engagement when interlocking finger-shaped tabs and finger-shaped voids (see e.g., finger-shaped tab 307*a* and finger-shaped void 307*b* of FIG. 3) of the finger joint 407. Further, the s-shaped tenon and groove profile lacks angular recesses that could collect contaminates.

During assembly, panels 403, 404 are aligned in the y-z plane, the interlocking plan (not shown) of the panels 403, 404 is aligned in the z-direction, and the interlocking profile (e.g., the depicted s-shaped tenon and groove) is aligned in the x-direction. The panels 403, 404 are interlocked by moving the panels 403, 404 toward one another in the z-direction. Once assembled, the interlocking plan secures the panels 403, 404 from movement in relation to one another in the y-direction, as well as limits movement in the z-direction. The interlocking profile secures the panels 403, 404 from movement in relation to one another in the x-direction.

The s-shaped tenon and groove profile is cut into the edge surfaces 480, 482 of the panels 403, 404, respectively, leaving flat shoulders (which may vary in size) on each side that creates a tight interlocking lateral bond when used in combination with the interlocking plan (not shown). In some implementations, the s-shaped tenon and groove profile cut into each of the edge surfaces 480, 482 is identical, but cut from a reverse x-direction. In other implementations, the s-shaped tenon and groove profile is unique to each of the panels 403, 404. The s-shaped tenon and groove interlocking profile may also vary in size and shape from that depicted in FIG. 4 and may occupy a portion of or the entirety of the interfacing edge surfaces 480, 482. In other implementations, the interlocking profile may have a variety of other shapes (e.g., a saw-tooth plan, a square-wave plane, etc.) that lock the panels 403, 404 together.

Figure 5:
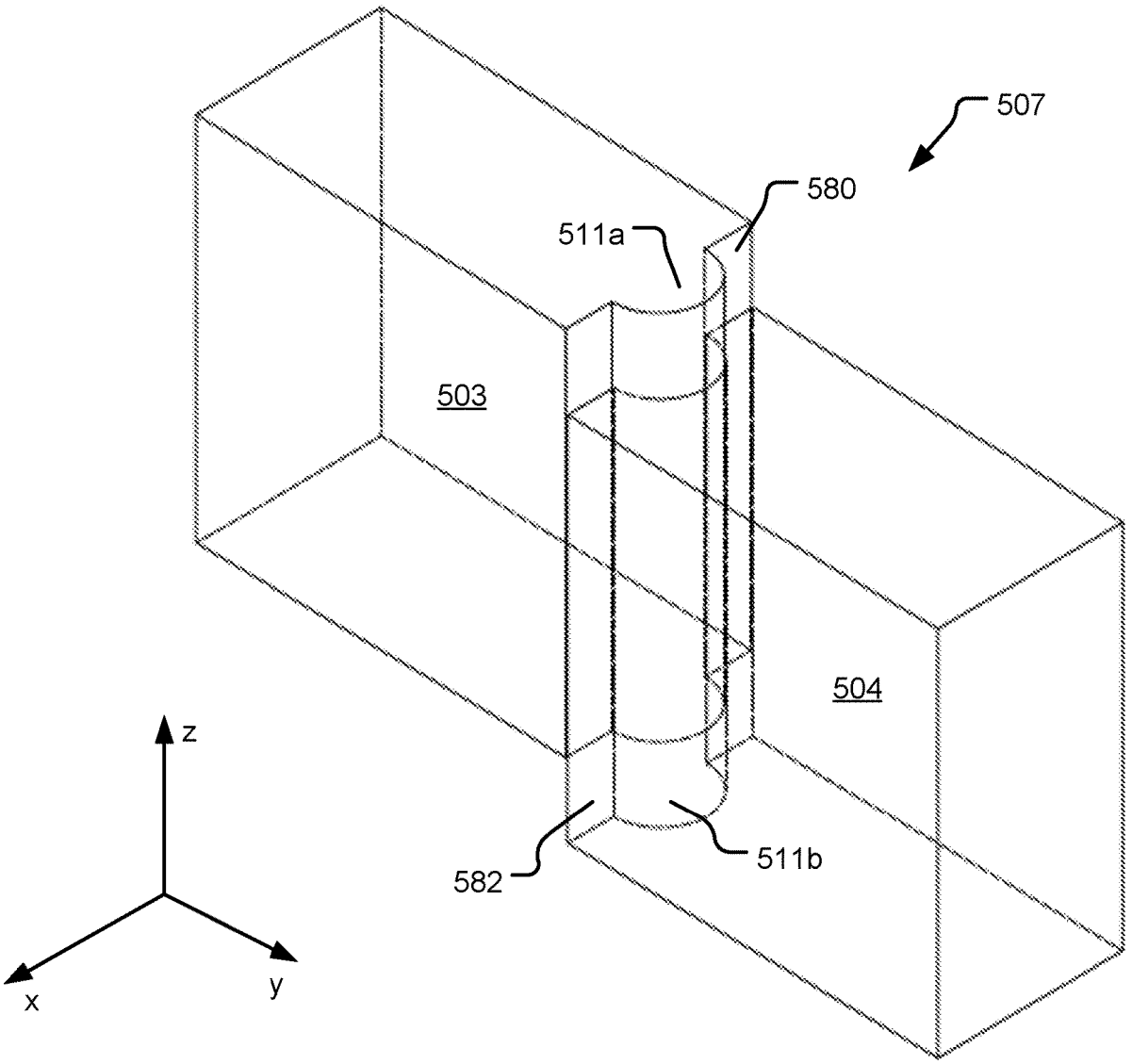
FIG. 5 is a detail view of a round-stub tenon and groove profile of an example interlocking finger joint.

FIG. 5 is a detail view of a round-stub tenon and groove profile of an example interlocking finger joint 507. The round-stub tenon and groove interlocking profile is formed in matching edge surfaces 580, 582 and may be cut along the entire edge surfaces 580, 582 (see e.g., FIGS. 1-3) to provide lateral stability and strength for the finger joint 507. The edge surfaces 580, 582 may be machined with a custom-made router bit that creates two matching interlocking profiles for interlocking engagement when interlocking finger-shaped tabs and finger-shaped voids (see e.g., finger-shaped tab 307*a* and finger-shaped void 307*b* of FIG. 3) of the finger joint 507. Further, the round-stub tenon and groove profile lacks angular recesses that could collect contaminates.

During assembly, panels 503, 504 are aligned in the y-z plane, the interlocking plan (not shown) of the panels 503, 504 is aligned in the z-direction, and the interlocking profile (e.g., the depicted round-stub tenon and groove) is aligned in the x-direction. The panels 503, 504 are interlocked by moving the panels 503, 504 toward one another in the z-direction. Once assembled, the interlocking plan secures the panels 503, 504 from movement in relation to one another in the y-direction, as well as limits movement in the z-direction. The interlocking profile secures the panels 503, 504 from movement in relation to one another in the x-direction.

The round-stub tenon and groove interlocking profile may vary in size and shape from that depicted in FIG. 5 and may occupy a portion of or the entirety of the interfacing edge surfaces 580, 582. In other implementations, the interlocking profile have a variety of other shapes (e.g., a saw-tooth plan, a square-wave plane, etc.) that lock the panels 503, 504 together.

In various implementations, the round-stub tenon and groove profile of FIG. 5 may be used in place of the s-shaped tenon and groove profile of FIG. 4. When used in the construction of the interlocking finger joint 507, the round-stub tenon and groove profile provides a similar function as the S-shaped tenon and groove profile of FIG. 4 in keeping the panels 503, 504 interlocked under shear force in the x-direction. In various implementations, the round-stub tenon and groove profile may have a bead 511*a* on the panel 503 and a cove 511*b* on the panel 504 to create nesting round surfaces. The rounded stub tenon (or bead) and the corresponding rounded groove (or cove) are cut into the edge surfaces 580, 582 of the panels 503, 504, respectively, leaving flat shoulders (which may vary in size) on each side that creates a tight interlocking lateral bond when used in combination with the interlocking plan (not shown). The round-stub tenon and groove profile may eliminate a rectangular slot traditionally created in a stub tenon and groove joint and replaces it with a dished-out cove that makes assembling the interlocking panels 503, 504 easier. The dished-out cove also makes cleaning easier since there is no rectangular recessed slot with tight corners for material or contaminates to accumulate within.

Figure 6:
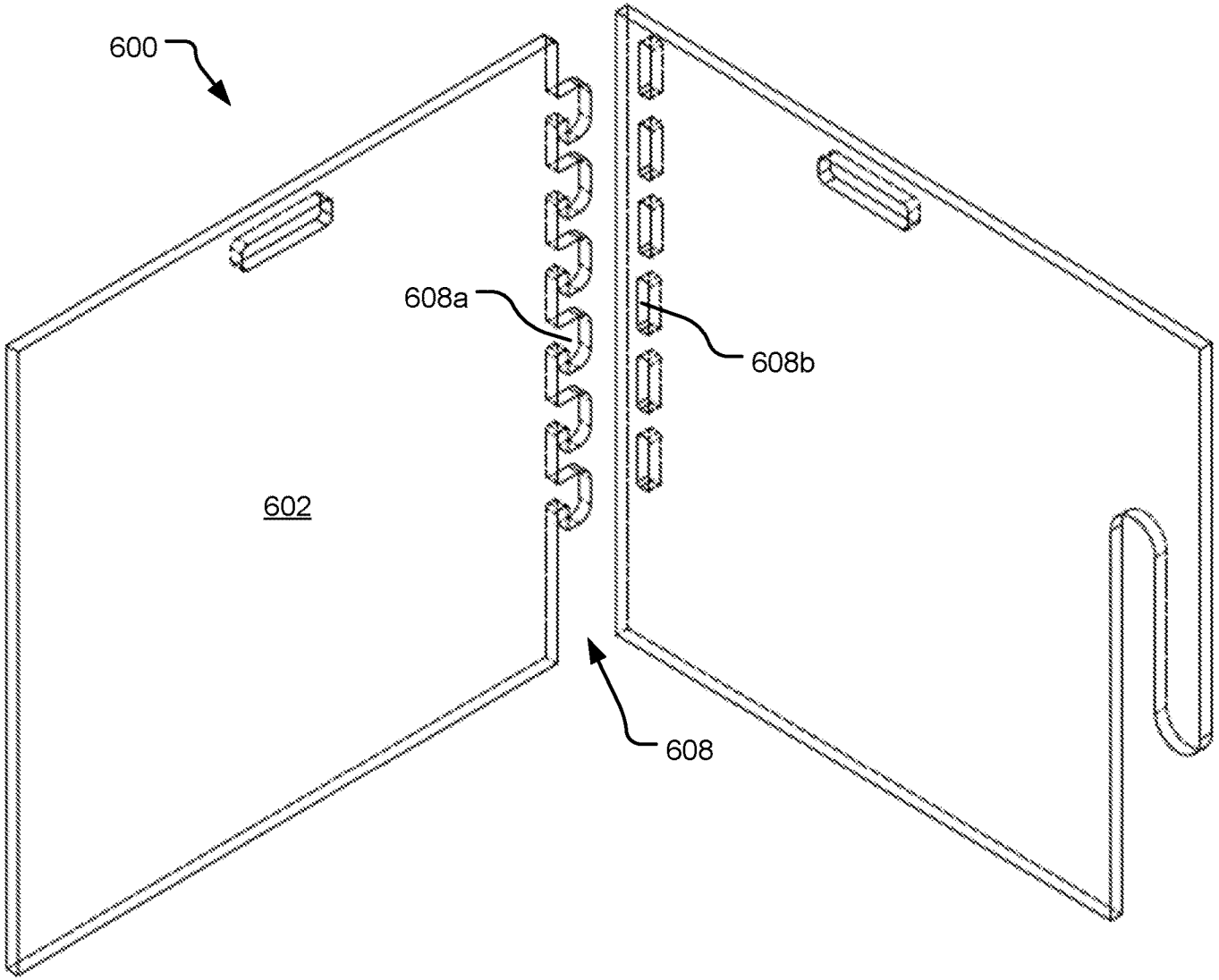
FIG. 6 is a perspective view of an interlocking D-tab and slot corner joint of an example disassembled interlocking panel system.

FIG. 6 is a perspective view of an interlocking D-tab and slot corner joint 608 of an example disassembled interlocking panel system 600. A D-tab edge may be formed by routing the edge with a ¼" diameter routing bit lateral to a face of panel 602 using a pre-formed jig for consistency. The pattern formed may create a series of tabs (e.g., tab 608*a*) that are 2" tall, 1½" wide, with a 1" tall and ½" wide void that selectively hooks through and locks into slots (e.g., slot 608*b*) on corresponding panel 603, although, other dimensions of the tabs 608*a* are contemplated herein. A slotted edge in the panel 603 may be plunge cut with a ¼" diameter routing bit leaving a series of voids in the panel 603 that are 2" tall and ½" wide, although, other dimensions of the voids 608*b* are contemplated herein.

To assemble the joint 608, the panels 602, 603 are placed at approximately 90 degrees to each other. The panel 602 is lifted and the D-tabs are inserted into the corresponding slots, then the panel 602 is lowered until the D-tabs interlock in the corresponding slots. Compared to a half-lap corner joint (not shown, see e.g., joint 1530 of FIG. 15), the joint 608 reduces the height that an assembler must reach to align and slide the two panels 602, 603 into position. The offset of the joint 608 may require a vertical lift of less than 1", for example.

Figure 7:
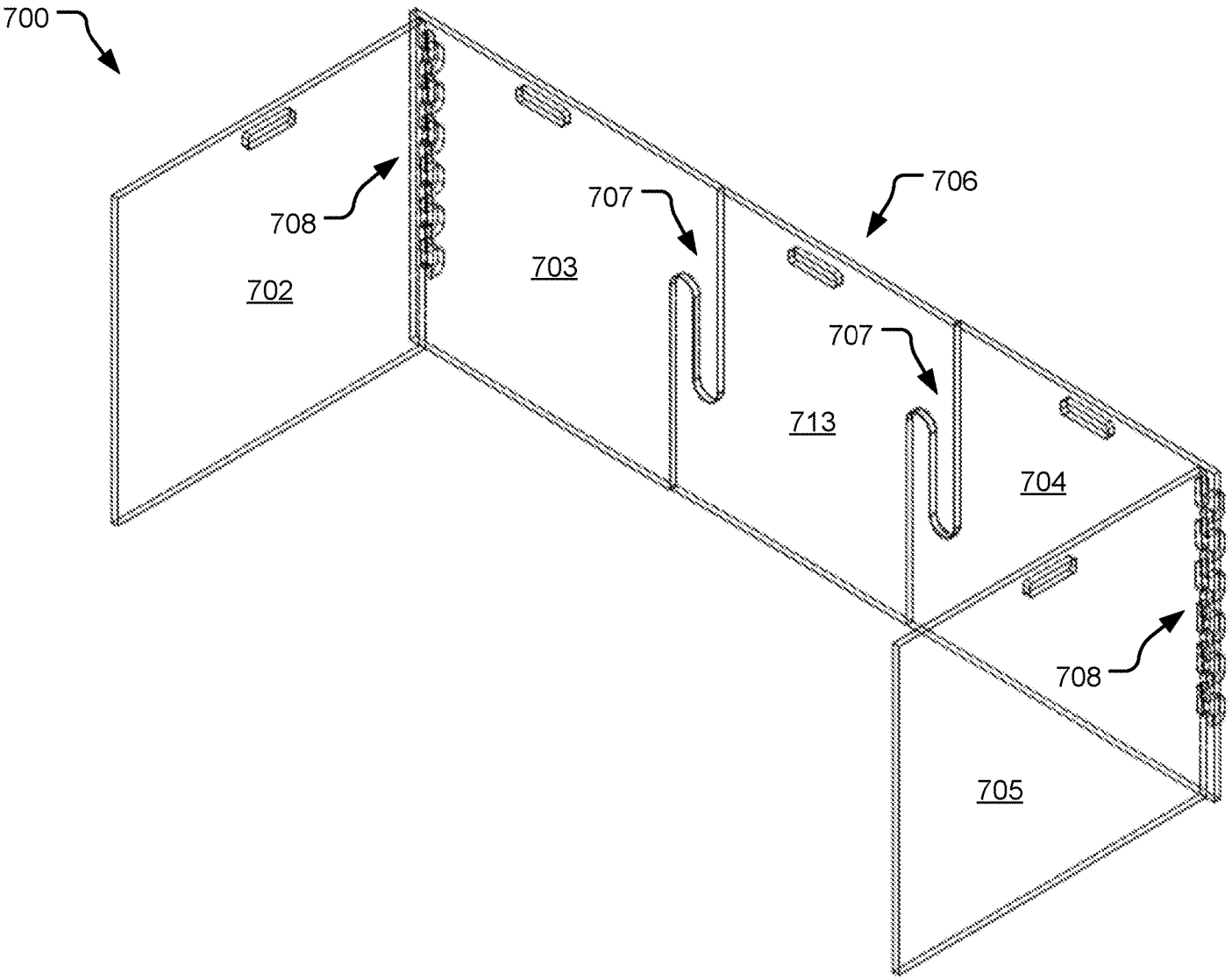
FIG. 7 is a perspective view of an example 5-panel interlocking panel system.

FIG. 7 is a perspective view of an example 5-panel interlocking panel system 700. The system 700 includes left panel 702, left-rear panel 703, expander rear panel 713, right-rear panel 704, and right panel 705. The rear panels 703, 704, 713 are selectively joined together at interlocking finger joints 707 to form a rear wall 706. The left panel 702 is attached to the left-rear panel 703 and the right panel 705 is attached to the right-rear panel 704 at D-tab and slot corner joints 708, which renders the system 700 self-supporting without the use of any separate fasteners. Various additional features of the system 700 are similar to that described above with regard to systems 100, 200 of FIGS. 1 and 2.

The expander panel 713 includes two interlocking finger joints 707 to interlock with the left-rear panel 703 and the right-rear panel 704 using the expander panel 713 to increase the width of back wall 706 of the system 700. Multiple expander panels permit the back wall 706 width to be modularly increased or decreased, while keeping the individual panel pieces small and light enough for a person to handle for transport to a sink for cleaning or elsewhere for storage. Additionally, the expander panel 713 width may be customized to create any desired specific width of the system 700, while keeping the left-rear panel 703 and the right-rear panel 704 consistently sized for manufacturing efficiency.

Figure 8:
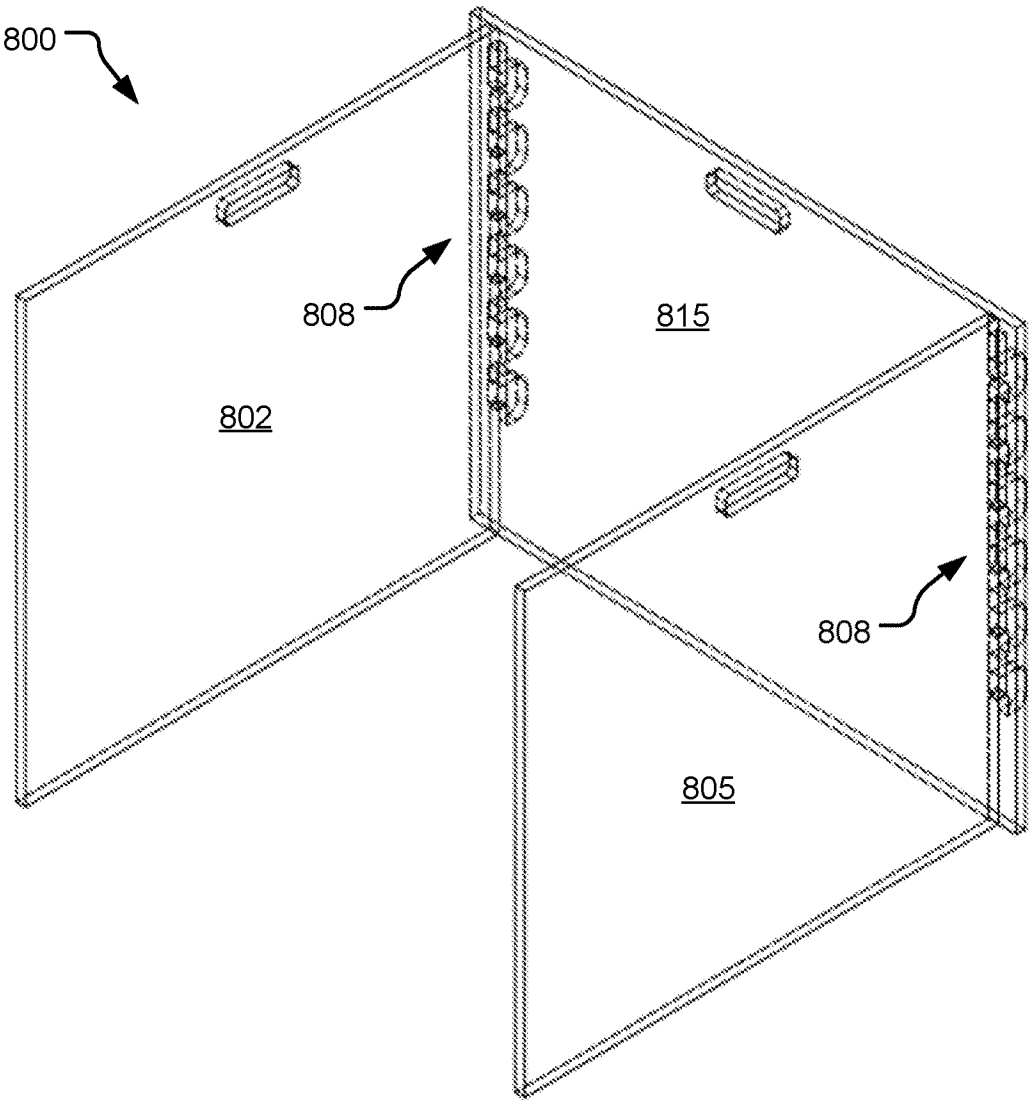
FIG. 8 is a perspective view of an example 3-panel interlocking panel system.

FIG. 8 is a perspective view of an example 3-panel interlocking panel system 800. The system 800 includes left panel 802, center panel 815, and right panel 805. The panels 802, 805 are each attached to the center panel 815 at D-tab and slot corner joints 808, which renders the system 800 self-supporting without the use of any separate fasteners. In other implementations, the panels 802, 805 are each attached to the center panel 815 at half-lap joints (not shown, see e.g., joint 1430 of FIG. 14). Various additional features of the system 800 are similar to that described above with reference to systems 100, 200 of FIGS. 1 and 2.

In various implementations, the center panel 815 is functional for systems less than 36" wide and approximately 24" tall. At this size or smaller dimensions, the panels 802, 805, 814 are small and light enough for a person to handle for transport to a sink or storage. Assemblies with wider rear walls may be made from multiple interlocking panels to reduce the size and weight of the individual panels (see e.g., system 700 of FIG. 7).

Figure 9:
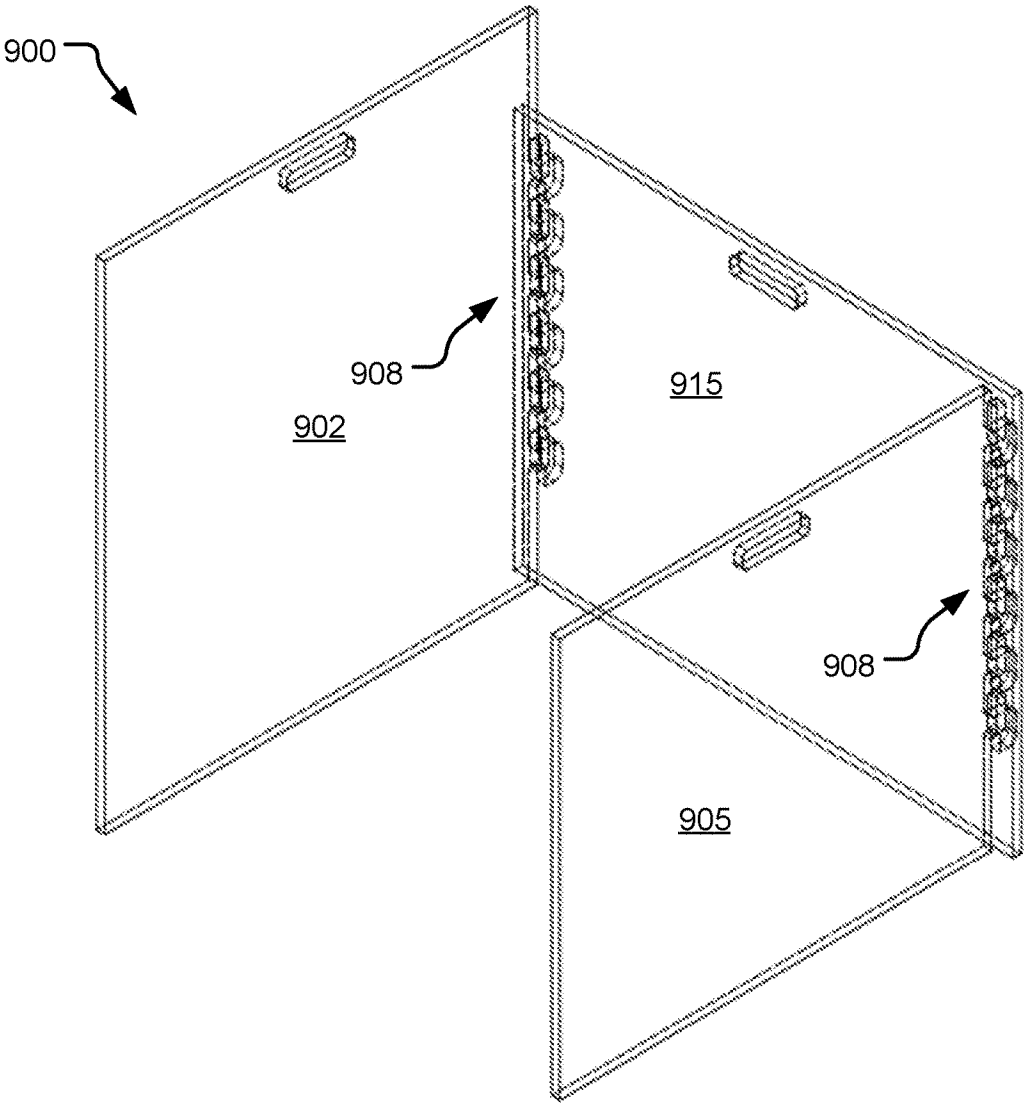
FIG. 9 is a perspective view of an example 3-panel interlocking panel system with varied height side panels.

FIG. 9 is a perspective view of an example 3-panel interlocking panel system 900 with varied height side panels 902, 905. The system 900 includes left panel 902, center panel 915, and right panel 905. The panels 902, 905 are each attached to the center panel 915 at D-tab and slot corner joints 908, which renders the system 900 self-supporting without the use of any separate fasteners. In other implementations, the panels 902, 905 are each attached to the center panel 915 at half-lap joints (not shown, see e.g., joint 1430 of FIG. 14). Various features of the system 900 are similar to that described with regard to systems 100, 200 of FIGS. 1 and 2. Panel 902 is depicted substantially taller than panel 905. Panel heights may be varied for customized uses on any interlocking panel systems (e.g., 3-panel systems, 4-panel systems, and interlocking panel systems that includes one or more expander panels).

Figure 10:
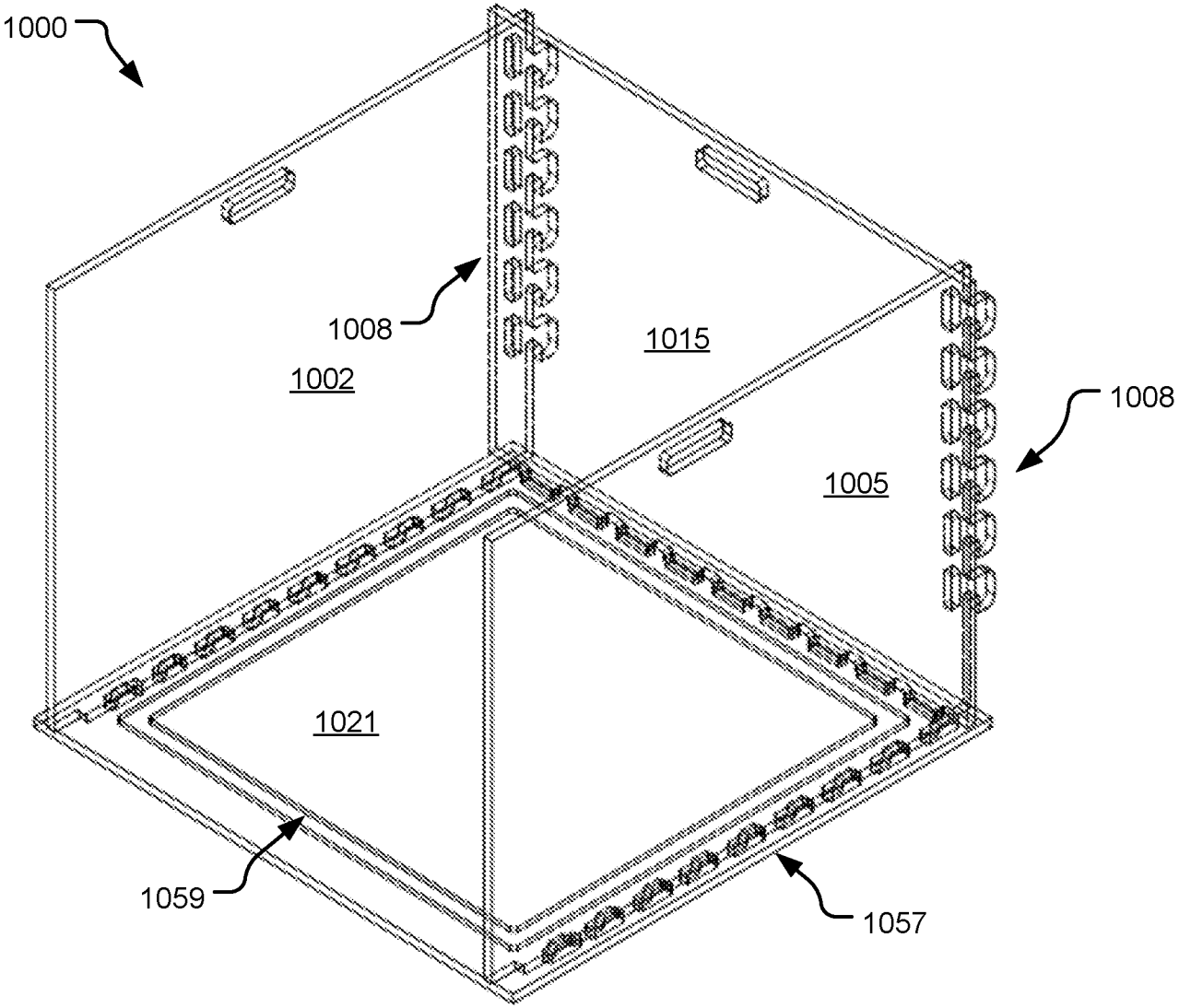
FIG. 10 is a perspective view of an example interlocking panel system with an interlocked work surface panel.

FIG. 10 is a perspective view of an example interlocking panel system 1000 with an interlocked work surface panel 1021. The system 1000 includes left panel 1002, center panel 1015, and right panel 1005. The panels 1002, 1015 are each attached to the center panel 1015 at D-tab and slot corner joints 1008, which renders the system 1000 self-supporting without the use of any separate fasteners. Tenon and slot joint 1057 on the bottom of the system 1000 is made up of a series of tenons extending from the bottom of the panels 1002, 1015, 1005 and slots within a 3-sided perimeter outline of the work surface panel 1021. The tenon and slot joint 1057 is used to attach the panels 1002, 1015, 1005 to the work surface panel 1021 to form the system 1000. Various additional features of the system 1000 are similar to that described above with reference to systems 100, 200 of FIGS. 1 and 2.

The work surface panel 1021 may be used to further contains contaminates within the system 1000. A top of the work surface panel 1021 may feature a shallow trough 1059, which may be 1¼" wide and ¼" deep running ½" inside the internal perimeter formed by the panels 1002, 1015, 1005, for example. The trough 1059 may function to retain spillage of liquid or solid matter.

Figure 11:
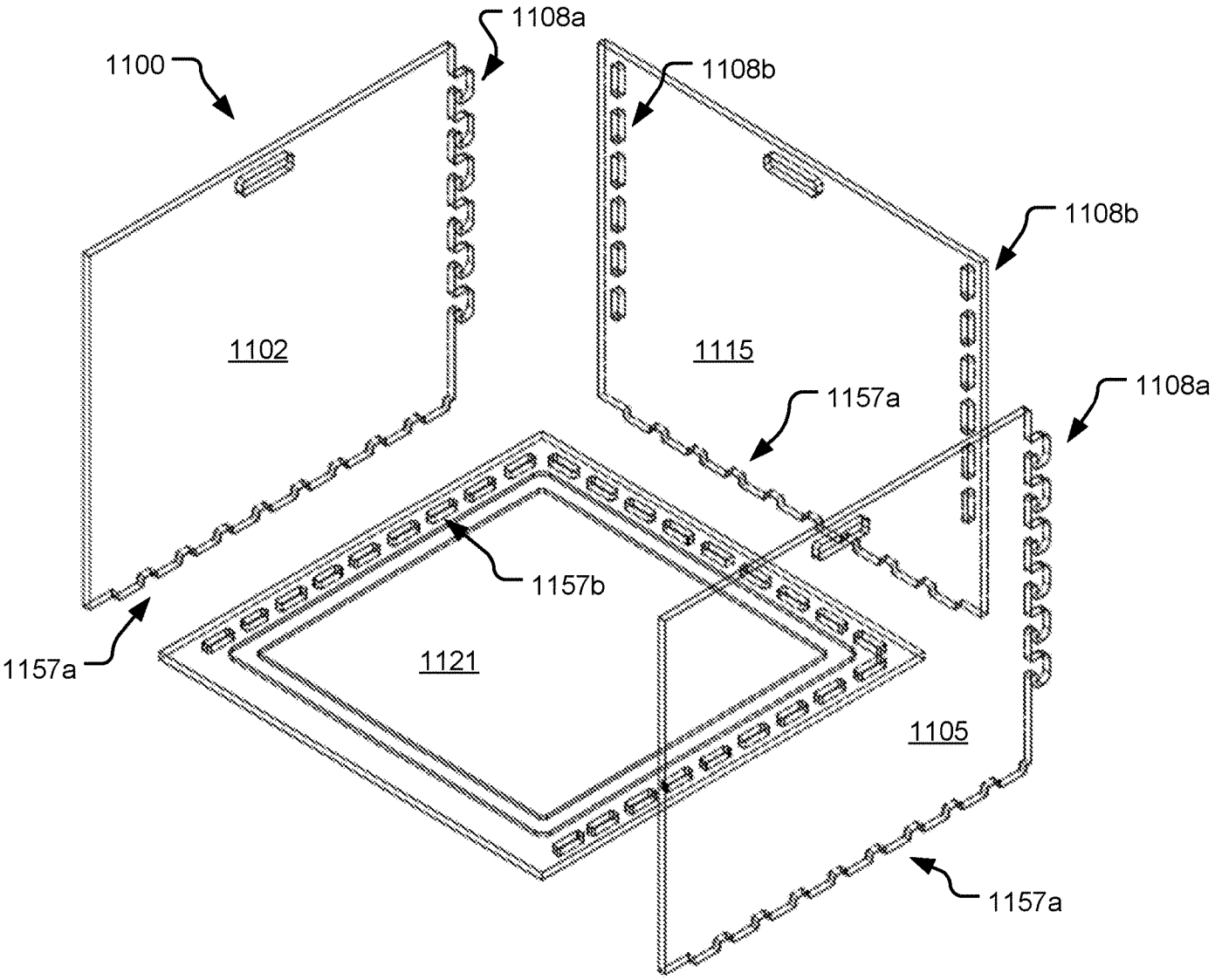
FIG. 11 is a perspective view of an example disassembled interlocking panel system with an interlockable work surface panel.

FIG. 11 is a perspective view of an example disassembled interlocking panel system 1100 with an interlockable work surface panel 1121. The system 1100 includes left panel 1102, center panel 1115, and right panel 1105. D-tabs 1108*a* of the left panel 1102 and the right panel 1105 are inserted into slots 1108*b* of the center panel 1115. The panels 1102, 1115, 1105 are set on top of the work surface panel 1121, aligning tenons 1157*a* on the panels 1102, 1115, 1105 with slots 1157*b* on the work surface panel 1121. Pressing down on the panels 1102, 1015, 1105 sets the tenons 1157*a* into the slots 1157*b*. In various implementations, the tenons 1157*a* fit into the slots 1157*b* are machined or otherwise formed to fit snugly together. Various additional features of the system 1100 are similar to that described above with reference to systems 100, 200 of FIGS. 1 and 2.

Figure 12:
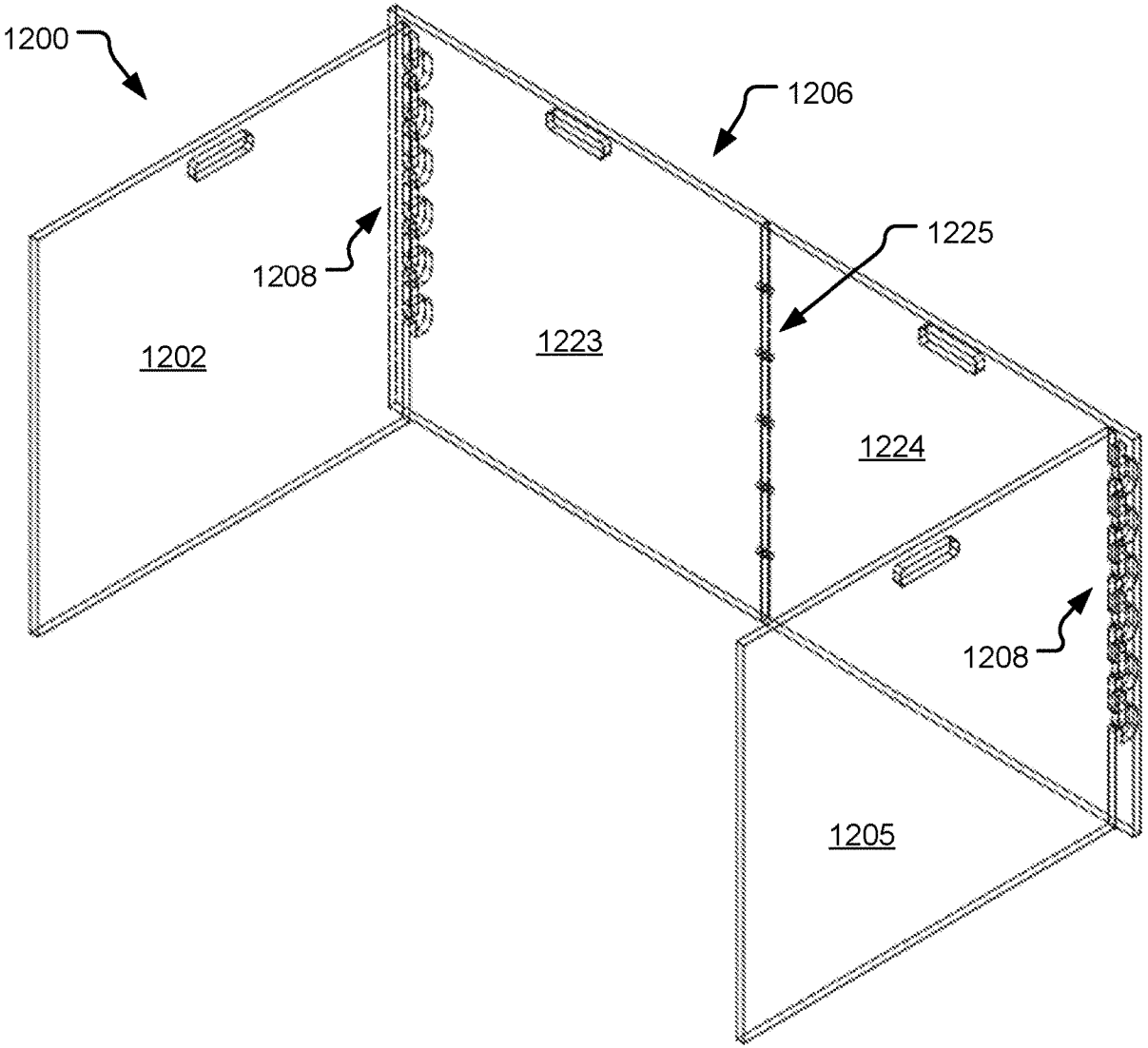
FIG. 12 is a perspective view of an example 4-panel interlocking panel system with a magnetic butt jointed rear wall.

FIG. 12 is a perspective view of an example 4-panel interlocking panel system 1200 with a magnetic butt jointed rear wall 1206. The system 1200 includes four individual separable panels, a left panel 1202, a left-rear panel 1223, a right-rear panel 1224, and a right panel 1205. The left-rear panel 1223 and the right-rear panel 1224 are selectively joined together at magnetic butt joint 1225 to form the rear wall 1206. The left panel 1202 is attached to the left-rear panel 1223 and the right panel 1205 is attached to the right-rear panel 1224 at D-tab and slot corner joints 1208, which renders the system 1200 self-supporting without the use of any separate fasteners.

In an example implementation, the magnetic butt joint 1225 is formed by a series of holes bored into the corresponding vertical edges of the rear panels 1223, 1224. The holes are drilled at approximately regular intervals and are centered longitudinally along the edges of the rear panels 1223, 1224. The holes on each of the edges of the rear panels 1223, 1224 are filled with magnets that align precisely when the system 1200 is assembled. Various additional features of the system 1200 are similar to that described above with reference to systems 100, 200 of FIGS. 1 and 2.

Figure 13:
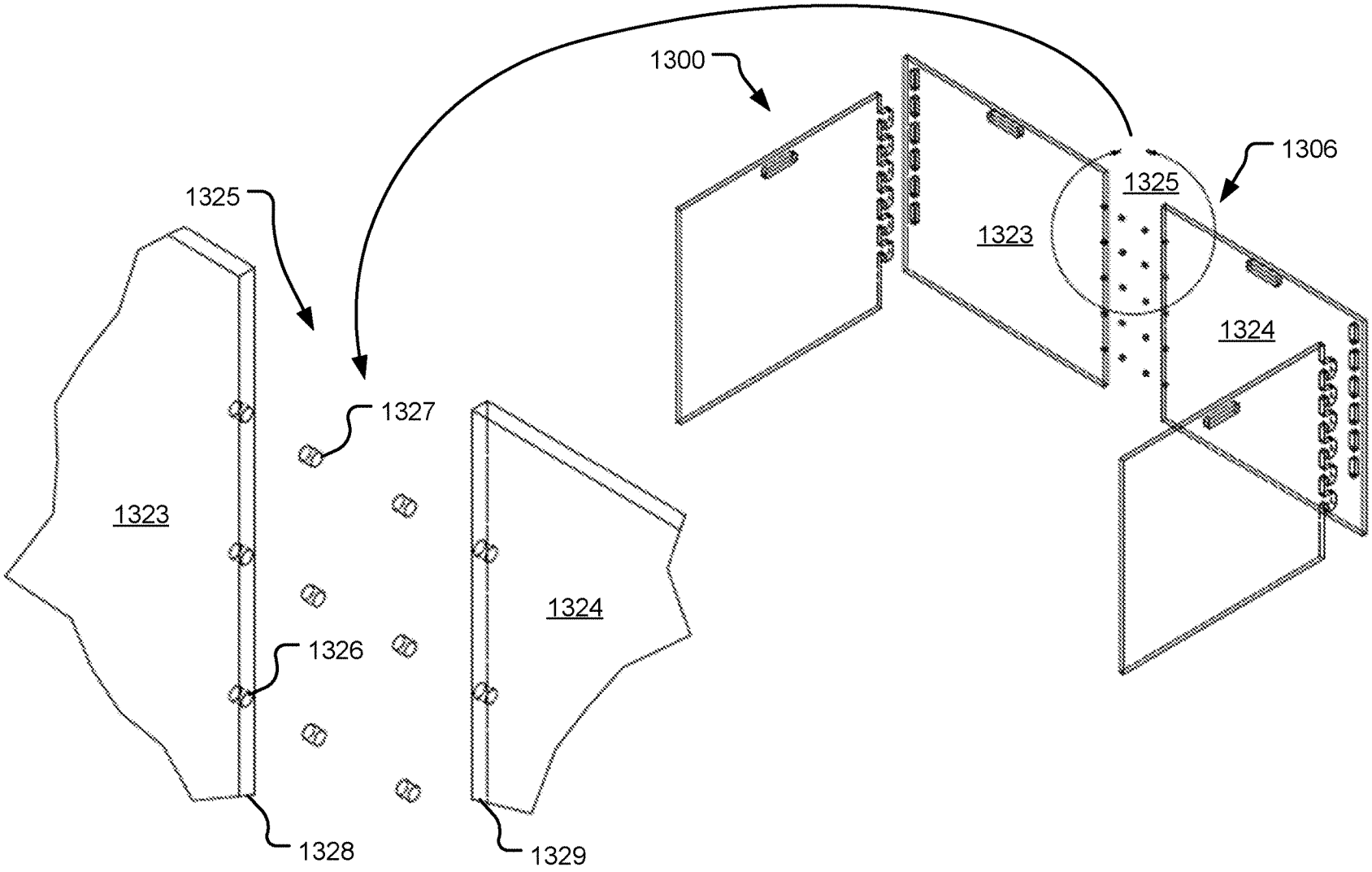
FIG. 13 is an exploded detail view of an example magnetic butt joint for an interlocking panel system.

FIG. 13 is an exploded detail view of an example magnetic butt joint 1325 for an interlocking panel system 1300. In an example implementation, the magnetic butt joint 1325 is formed by ⅜" diameter holes (e.g., hole 1326) bored laterally ⅜" deep into the corresponding vertical edges 1328, 1329 of panels 1323, 1324. The holes are drilled at approximately 6" intervals and are centered longitudinally along the edges 1328, 1329. The holes are filled with cylindrical magnets (e.g., magnet 1327) that align precisely when the system 1300 is assembled.

For example, the magnets may be cylinder-shaped neodymium magnets that are ⅜" long and ⅜" in diameter. The magnets are press-fit into each of the bored holes, being sure to properly orientate the magnet's polarity to cause attraction between the corresponding magnets within the panels 1323, 1324. The magnetic butt joint 1325 creates a coplanar rear wall 1306 that is self-joining and self-aligning. Various additional features of the system 1300 are similar to that described above with reference to systems 100, 200 of FIGS. 1 and 2.

Figure 14:
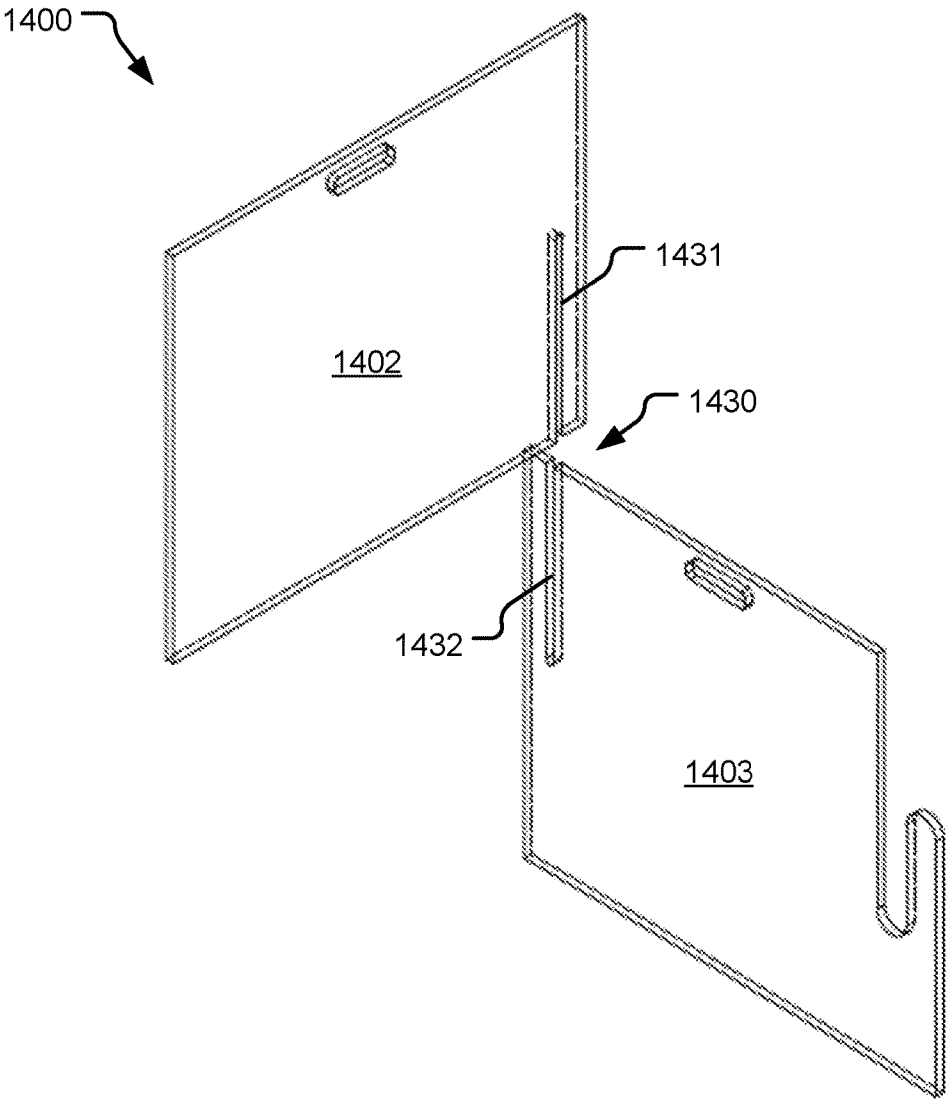
FIG. 14 is a perspective view of an example disassembled half-lap corner joint for an interlocking panel system.

FIG. 14 is a perspective view of an example disassembled half-lap corner joint 1430 for an interlocking panel system 1400. Panel 1402 with half-lap (or u-shaped slotted void) 1431 is joined to panel 1403 with half-lap (or u-shaped slotted void) 1432. Each of the u-shaped slotted voids 1431, 1432 half-laps the other at a 90° angle to form rigid corner connections. The corner joint 1430 may be constructed by cutting the u-shaped slotted voids 1431, 1432 perpendicular to the face of the panels 1404, 1404. For example, the u-shaped slotted void 1431 is cut from the bottom of the panel 1402 face to a depth equal to half of the panel 1402 height, plus an additional $1/6^{th}$ inch. The u-shaped slotted void 1432 is cut from the top of the panel 1403 face to a depth equal to half of the panel 1403 height, plus an additional $1/6^{th}$ inch. The voids 1431, 1432 cut in the panels 1404, 1404 may leave sufficient material to maintain a rigid overlap that will not easily break in use, assembly or disassembly.

To assemble the corner joint 1430, the slotted void 1431 is aligned above the slotted void 1432 at a 90-degree angle and then lowered into place. Additional corner panels (not shown) may also be manufactured and assembled in the same manner is depicted and described with reference to the system 1400. To disassemble the corner joint 1430, the panel 1402 is lifted straight up until the interlocking voids 1431, 1432 are freed. Various additional features of the system 1400 are similar to that described above with reference to systems 100, 200 of FIGS. 1 and 2.

Figure 15:
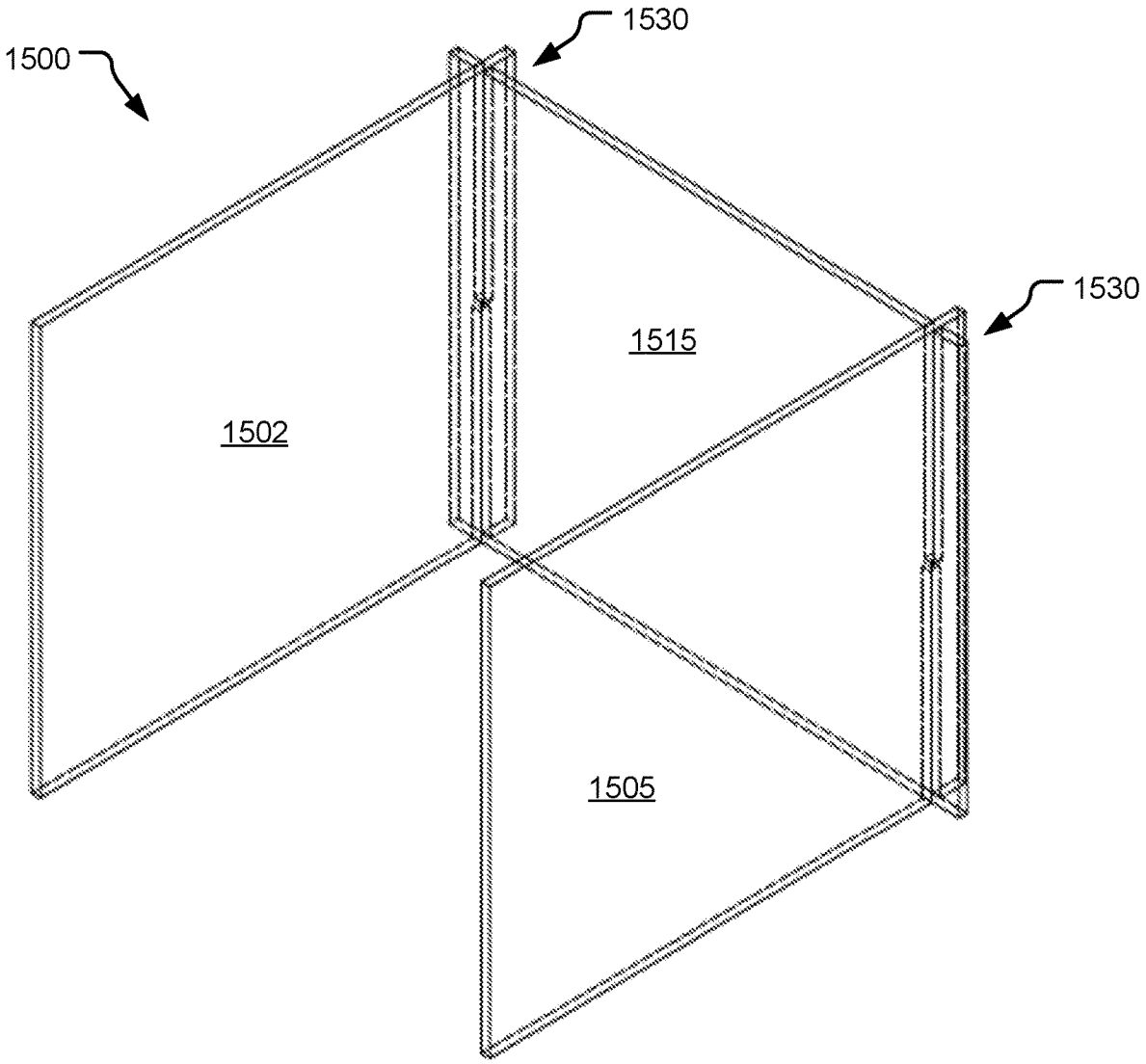
FIG. 15 is a perspective view of an example 3-panel interlocking panel system with half-lap corner joints.

FIG. 15 is a perspective view of an example 3-panel interlocking panel system 1500 with half-lap corner joints 1530. The system 1500 includes a left panel 1502 with a half-lap joint, a rear panel 1515 with opposing half-lap joints, and a right panel 1505 with a half-lap joint. The corners of the system 1500 are constructed with the half-lap joints 1530. Various additional features of the system 1500 are similar to that described above with reference to systems 100, 200 of FIGS. 1 and 2.

Figure 16:
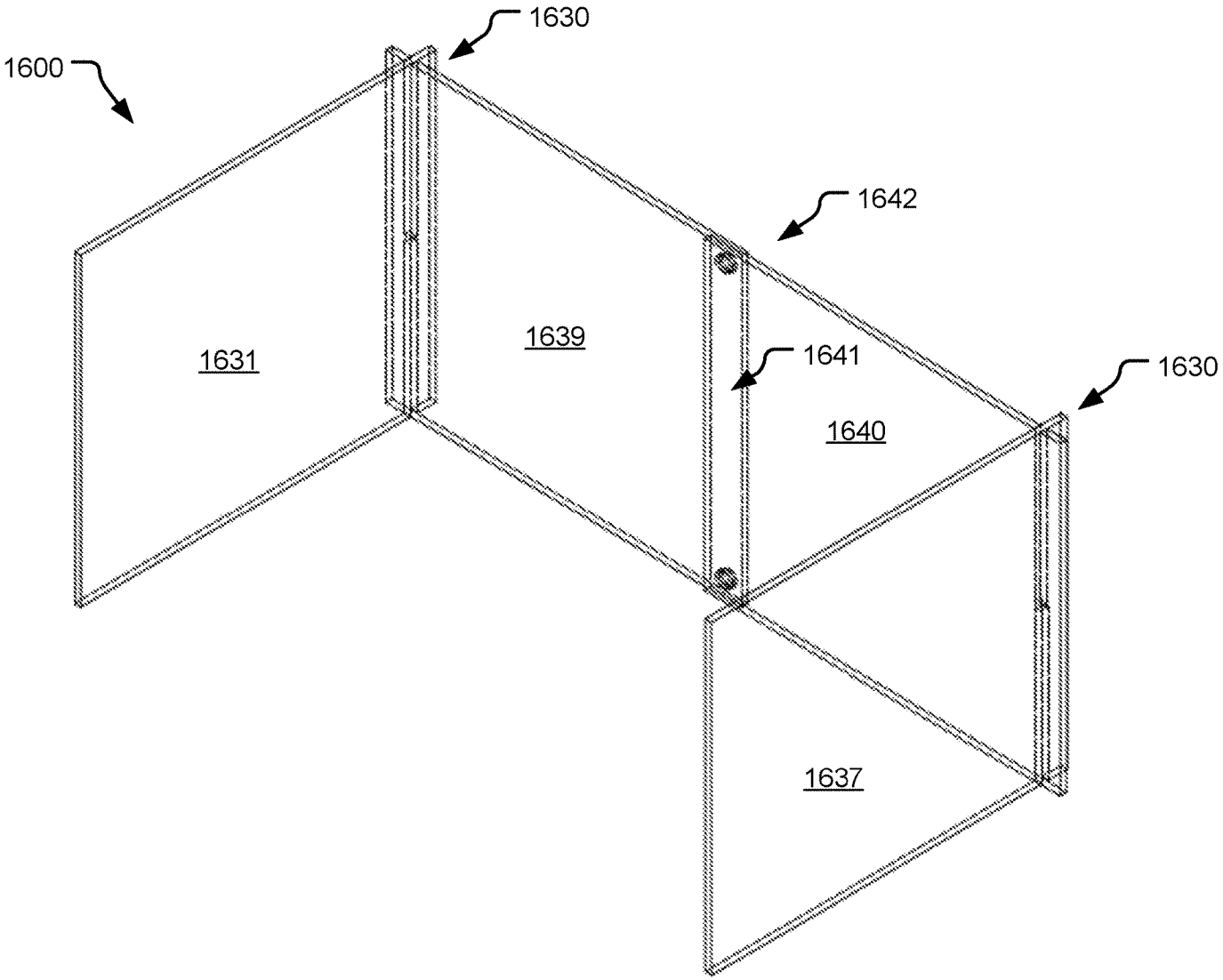
FIG. 16 is a perspective view of an example 4-panel interlocking panel system with a magnetic lap joint.

FIG. 16 is a perspective view of an example 4-panel interlocking panel system 1600 with a magnetic lap joint 1641. The system 1600 includes a left panel 1631, a left-rear panel 1639, a right-rear panel 1640, and a right panel 1637. Corners of the system 1600 may be constructed with the depicted half-lap joints 1630, as shown, D-tab and slot joints, other joints, or a combination thereof, for example. Rear wall 1642 includes panels 1639, 1640 joined with the magnetic lap joint 1641. In an example implementation, to form the magnetic lap joint 1641, the panels 1639, 1640 overlap approximately 2.5" where the front face of the left-rear panel 1639 contacts the back face of the right-rear panel 1640. The magnetic lap joint 1641 attaches the panels 1639, 1640 together.

In a specific example implementation, recesses are bored in each the panels 1639, 1640 to hold magnetic assemblies that align and attach the overlapping panels 1639, 1640. The bores for the magnetic cups are created in a back face of the right-rear panel 1640 to a depth equivalent to the depth of the magnet cups used. At the top of the panel overlap on the back face of the right-rear panel 1640, a 1.125" hole is bored on center 1.25" from the top and 1.25" from the edge of the panel 1640. At the bottom of the panel overlap on the back face of the panel 1640, a 1.125" hole is bored on center 1.25" from the bottom and 1.25" from the edge of the panel 1640. A bore for a washer is bored into the front face of the left-rear panel 1639 to a depth equivalent to the depth of the washer being used. At the top of the panel overlap on the front face of the left-rear panel 1639, a 1.125" hole is bored on center 1.25" from the top and 1.25" from the edge of the panel 1639. At the bottom of the panel overlap on the front face of the left-rear panel 1639, a 1.125" hole is bored on center 1.25" from the bottom and 1.25" from the edge of the panel 1639. Various additional features of the system 1600 are similar to that described above with reference to systems 100, 200 of FIGS. 1 and 2.

Figure 17:
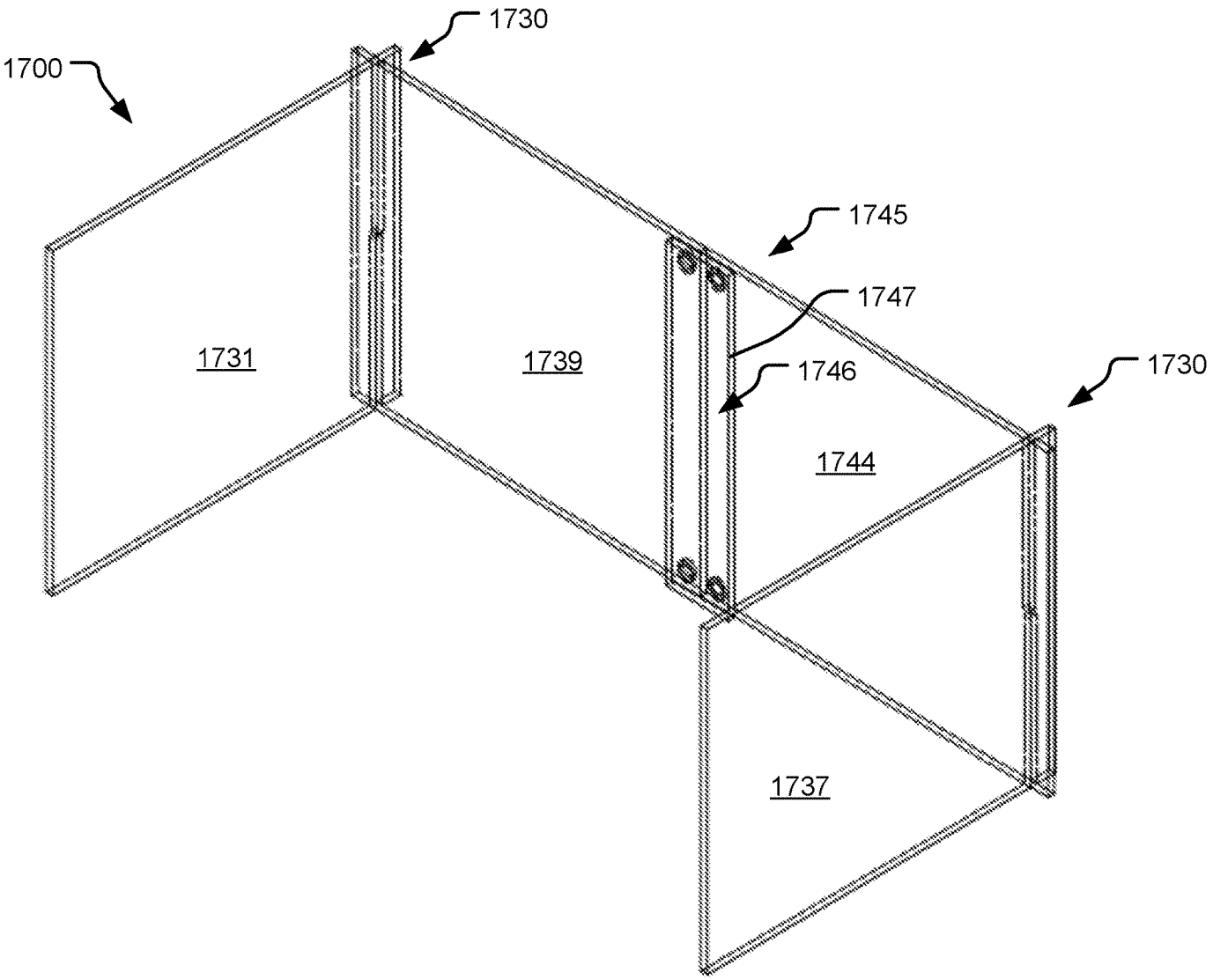
FIG. 17 is a perspective view of an example 4-panel interlocking panel system with a magnetic batten joint.

FIG. 17 is a perspective view of an example 4-panel interlocking panel system 1700 with a magnetic batten joint 1746. The system 1700 includes a left panel 1731, a left-rear panel 1739, a right-rear panel 1744, and a right panel 1737. Corners of the system 1700 may be constructed with the depicted half-lap joints 1730, as shown, D-tab and slot joints, other joints, or a combination thereof, for example. Rear wall 1745 includes panels 1739, 1744 joined with the magnetic batten joint 1746. In an example implementation, to form the magnetic batten joint 1746, the rear panels 1739, 1744 butt on the same plane. An overlapping 5" wide batten panel 1747 is magnetically-joined to each of the panels 1739, 1744. In the magnetic batten joint 1746, 2.5" of the front face of the left-rear panel 1739 and 2.5" of the front face of the right-rear panel 1744 contacts the back face of the batten panel 1747. Various additional features of the system 1700 are similar to that described above with reference to systems 100, 200 of FIGS. 1 and 2.

Figure 18:
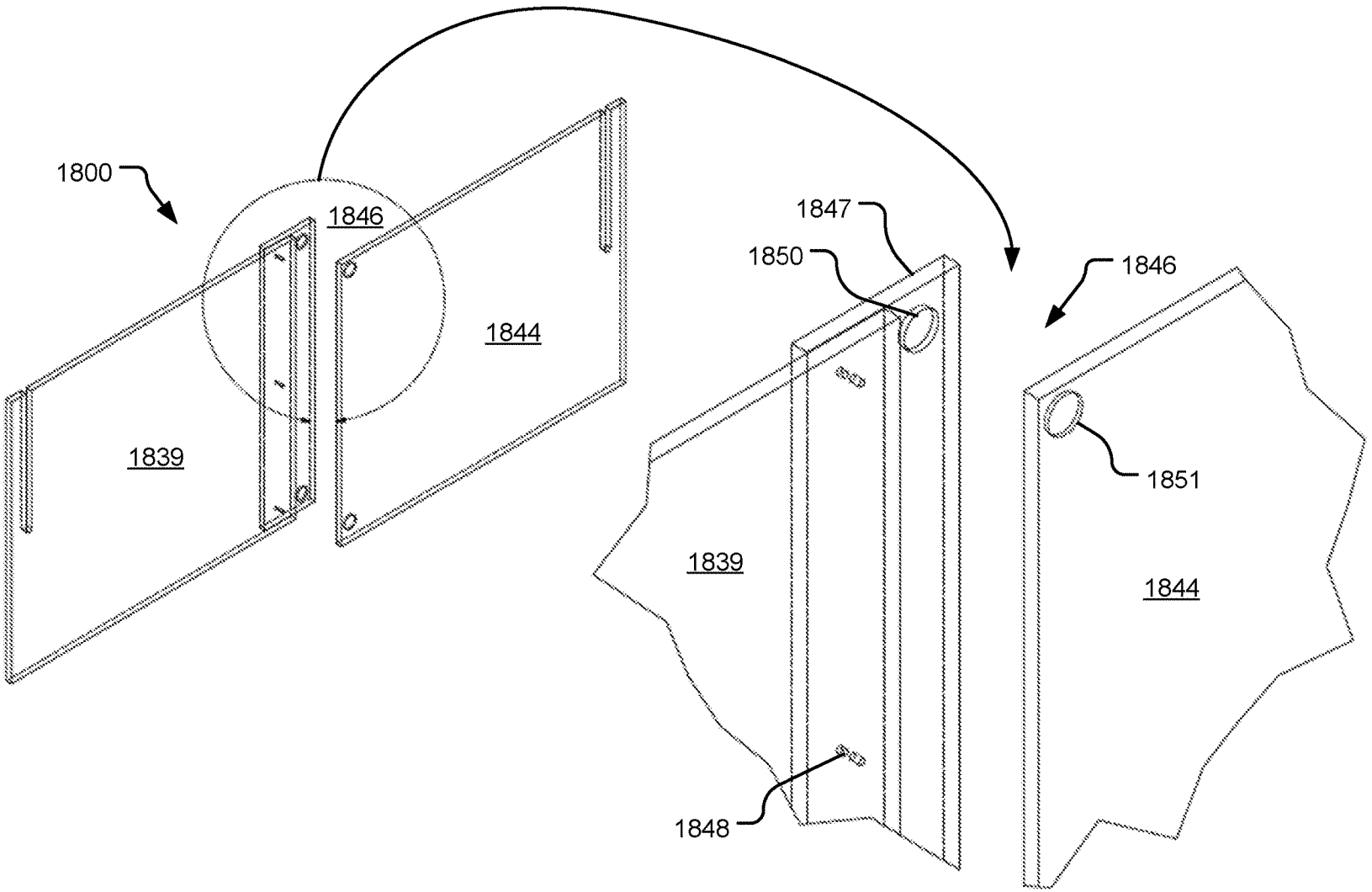
FIG. 18 is an exploded detail view of an example magnetic batten joint for an interlocking panel system.

FIG. 18 is an exploded detail view of an example magnetic batten joint 1846 for an interlocking panel system 1800. Panels 1839, 1844 are joined together with the magnetic batten joint 1846. For example, the panels 1839, 1844 butt on the same plane and an overlapping 5" wide batten panel 1847 is affixed to the panel 1839 with screws (not shown) extending through corresponding bores (e.g., bore 1848). Further, the batten panel 1847 includes bore 1850, which includes a magnetic cup. The panel 1844 includes a corresponding bore 1851, which includes a metallic washer (not shown). The magnetic cup and the washer are selectively attached to together form the magnetic batten joint 1846. In an example implementation, the front face of the panel 1844 contacts the back face of the batten panel 1847 when the magnetic batten joint 1846 is made. Various additional features of the system 1800 are similar to that described above with reference to systems 100, 200 of FIGS. 1 and 2.

Figure 19:
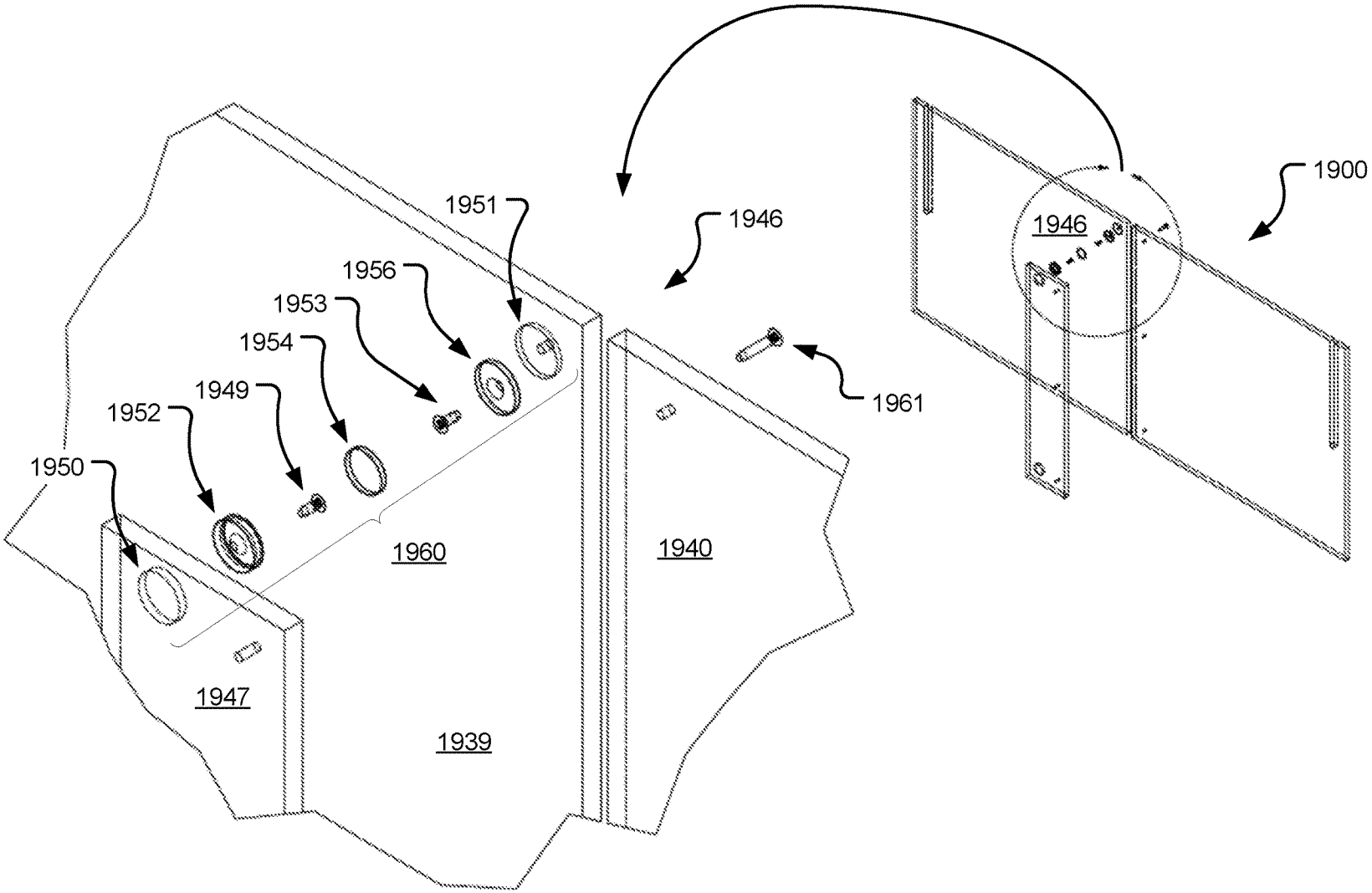
FIG. 19 is an exploded magnet assembly detail for a magnetic batten joint of an interlocking panel system.

FIG. 19 is an exploded magnet assembly 1960 for a magnetic batten joint 1946 of an interlocking panel system 1900. In an example implementation, a bore 1950 for magnet cup 1952 is made into batten panel 1947 to a depth equivalent to the depth of magnet cup 1952. The magnet cup 1952 may have a ribbed outer surface and be press fit into the bore 1950 but could be attached via other mechanisms. For example, the magnet cup 1952 may be permanently fixed into place with a ⅝" long, #10 flathead screw 1949 that is threaded into a corresponding predrilled hole. Neodymium magnet 1954, which is 1" in diameter and ⅛" thick, is magnetically affixed in the magnet cup 1952.

The batten panel 1947 is screwed to panel 1940 using screw 1961. Bore 1951 for washer 1956 is made into panel 1939 to a depth equivalent to the depth of washer 1956. The washer 1956 is inserted into the bore 1951 and is permanently affixed with a ½" long, #10 flathead screw 1953 that is threaded into a corresponding predrilled hole. Magnetic force between the magnet 1954 and the washer 1956 automatically aligns panels 1939, 1940 and attaches them together via the batten panel 1947. To disassemble the panels 1939, 1940, they may be pulled apart by grasping the top of each of the panels 1939, 1940 and pulling them apart with opposing forces. In various implementations, the magnetic batten joint 1946 may include multiple magnet assemblies such as the magnet assembly 1960 depicted in FIG. 19. Various additional features of the system 1900 are similar to that described above with reference to systems 100, 200 of FIGS. 1 and 2.

Figure 20:
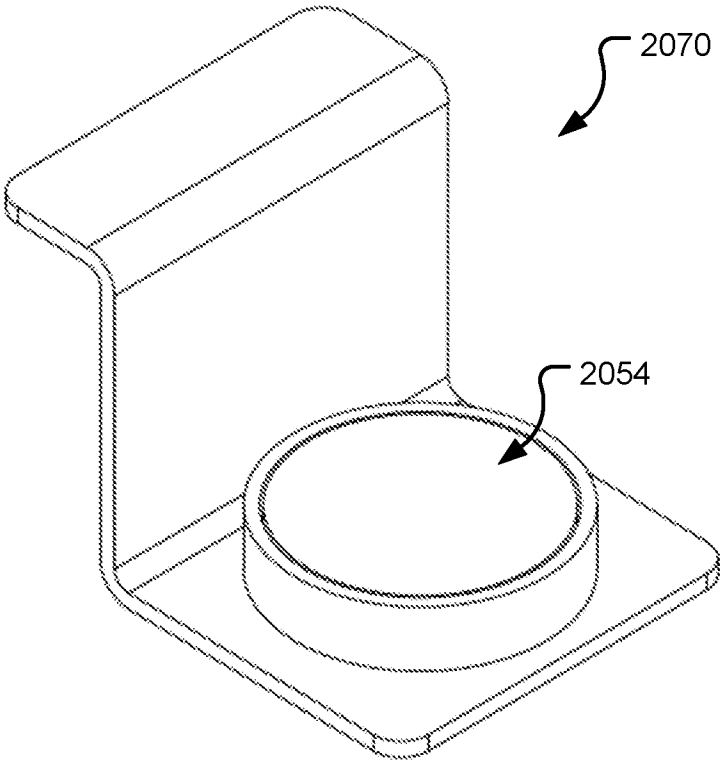
FIG. 20 is a perspective view of an example magnetic retaining brace for an interlocking panel system.

FIG. 20 is a perspective view of an example magnetic retaining brace 2070 for an interlocking panel system (not shown). The brace 2070 is an accessory that can help prevent any of the interlocking panel systems disclosed herein from sliding off from a corresponding work surface. In an example implementation, the brace 2070 is 1" wide strip of 14-gauge stainless steel flat stock formed to fit against the edge of a steel work table. The brace 2070 is adhered to the table with a 1" diameter and ⅛" thick neodymium magnet 2054.

Figure 21:
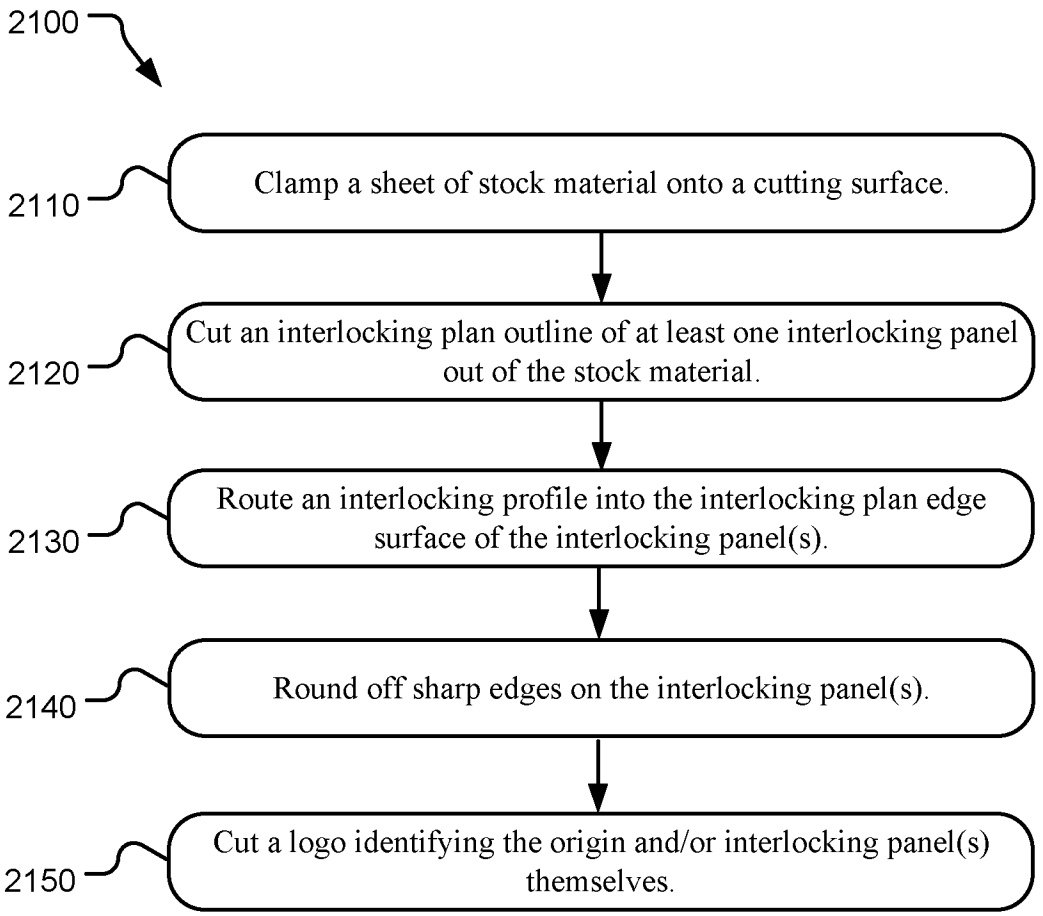
FIG. 21 illustrates example operations for manufacturing an interlocking panel system.

FIG. 21 illustrates example operations 2100 for manufacturing an interlocking panel system. A clamping operation 2110 clamps a sheet of stock material onto a cutting surface. The clamping operation 2110 may be achieved by mechanical clamps or a negative pressure applied to the stock material through the cutting surface, which may be vacuum table. The stock material may be of any convenience size, so long as it is big enough for at least one interlocking panel. For example, the stock material may be a 4'×8' sheet of ½" thick HDPE. In various implementations, each interlocking panel is referenced off the same cutting surface in order to achieve co-planar panels when assembled, particularly for finger joints having an interlocking plan and an interlocking profile.

A cutting operation 2120 cuts an interlocking plan outline of at least one interlocking panel out of the stock material. The cutting operation 2120 may be achieved by one or more of sawing, drilling, milling, routing, fluid-jet cutting, and plasma cutting. The interlocking plan outline may include, for example, a finger joint plan, a D-tab and slot joint plan, or other interlocking plan described in detail herein. Other features described in detail herein may also be cut into the interlocking panel via the cutting operation 2120.

A routing operation 2130 routes an interlocking profile into the interlocking plan edge surface of the interlocking panel(s). The routing operation 2130 may be achieved by running a routing bit (also referred to as a profiling bit) along the interlocking plan edge surface of the interlocking panel. The routing bit has a profile that matches the desired profile of the interlocking plan edge surface. The interlocking profile may include, for example, a finger joint profile, a D-tab and slot joint profile, or other interlocking profile described in detail herein.

A rounding operation 2140 rounds off sharp edges on the interlocking panel(s). The rounding operation 2140 may be achieved by applying a chamfer or bevel to sharp edges on the interlocking panel. Further, the rounding operation 2140 may be achieved mechanically, or by hand. A logo cutting operation 2150 cuts a logo identifying the origin and/or individual interlocking panel(s) themselves. The logo cutting operation 2150 may be achieved by sawing, drilling, milling, routing, fluid-jet cutting, plasma cutting, laser cutting, burning, or etching. The resulting logo may include a variety of information, including but not limited to a source manufacturer name and location, and a product name and identifying number.

The operations 2100 may be repeated to manufacture multiple interlocking panels to be used together in an interlocking panel system, as described in detail herein. Some of the manufactured interlocking panels may be identical, while others may be different. In an alternative method of manufacturing an interlocking panel system, the individual interlocking panels are molded in whole or in part rather than machined out of sheet stock as described in detail herein.

Figure 22:
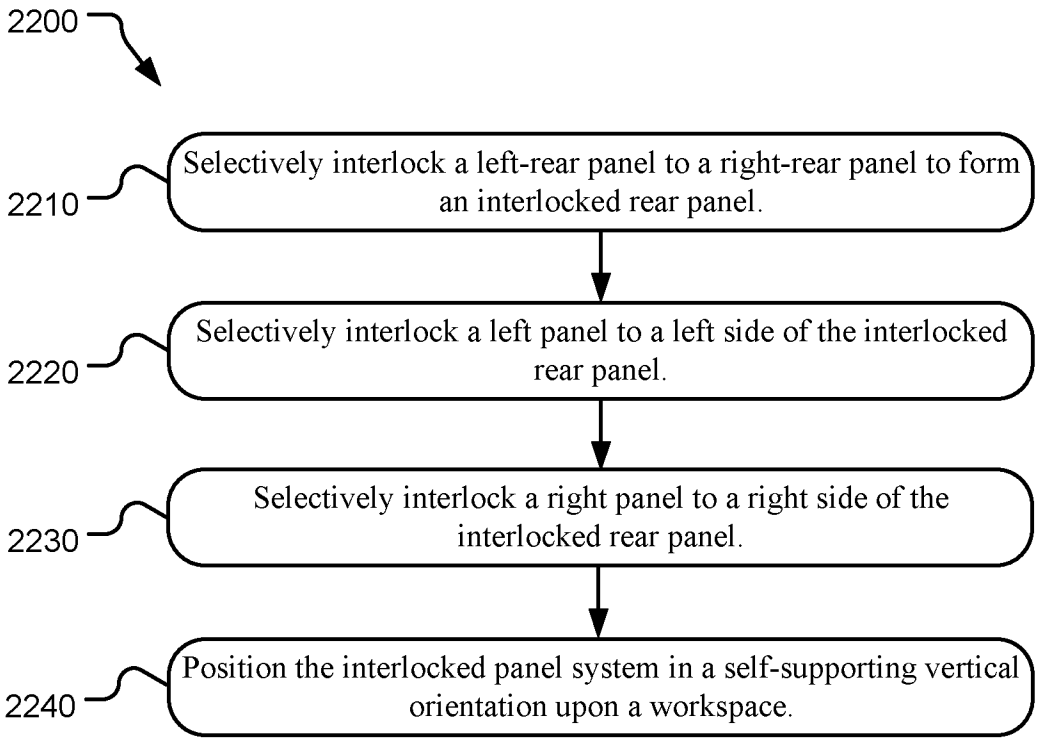
FIG. 22 illustrates example operations for using an interlocking panel system.

FIG. 22 illustrates example operations 2200 for using an interlocking panel system. A first interlocking operation 2210 selectively interlocks a left-rear panel to a right-rear panel to form an interlocked rear panel. The left-rear panel includes a first finger joint having an interlocking plan and an interlocking profile occupying an edge surface of the left-rear panel. The right-rear panel includes a second finger joint also having an interlocking plan and an interlocking profile occupying an edge surface of the right-rear panel. The first interlocking operation 2210 is achieved by slidably interfacing the first finger joint with the second finger joint of the left-rear panel and the right-rear panel, respectively.

The first interlocking operation 2210 interlocks the left-rear panel to the right-rear panel extending in a common planar direction. In some implementations, the first interlocking operation 2210 is achieved with the left-rear panel and the right-rear panel interlocked lying flat and then the interlocked rear panel is stood upright for interlocking operations 2220, 2230. In other implementations, the first interlocking operation 2210 may instead be accomplished by mechanically interfacing a magnetic batten joint, a magnetic lap joint, or other type of joint together.

A second interlocking operation 2220 selectively interlocks a left panel to a left side of the interlocked rear panel. A third interlocking operation 2230 selectively interlocks a right panel to a right side of the interlocked rear panel. The left and right panels each extend in a different plane (e.g., each at approximately 90 degrees) from the interlocked rear panel. The interlocking operations 2220, 2230 may be accomplished by mechanically interfacing one or both of a D-tab and slot joint and a half-lap corner joint together. A positioning operation 2240 positions the interlocked panel system in a self-supporting vertical orientation upon a workspace. The interlocking panel system surrounds the workspace on three sides. The fourth side is open so that a user may access the workspace.

In various implementations, the structural panels and portable workspace barriers (collectively interlocking panels) disclosed herein are portable, self-supporting, and modular systems that form barriers to function as a shield, guard, or containment around the sides of a workspace. Advantages of the presently disclosed technology include, without limitation, the interlocking panel's ability to be easily deconstructed for storage and/or to be transported to another workspace or to a wash sink. The interlocking panels are easily de-constructed and re-constructed by one person. The design of the interlocking panels allows for easy cleaning and sanitation. The materials of the components are moisture resistant and can be anti-microbial and/or fire-resistant. Further, the interlocking panel size may be customized to suit multiple user needs.

The presently disclosed technology may be applicable to in a variety of fields or industries, for example, food service (e.g., kitchens, restaurants, butchers, food bars, as a food-allergy barrier (e.g., isolating foods containing gluten, nuts, or dairy or kosher foods)), medical (e.g., hospitals, doctor offices, dental practices, veterinary practices, and pharmacies), scientific (e.g., clean rooms and laboratories), care giving (e.g., childcare and senior care), privacy partitions (e.g., voting and standardized testing), and healthcare (e.g., manicure and pedicure salons and estheticians), environmental (e.g., as a wind breaks in outdoor work areas or while camping), construction (e.g., structural panels for constructing an enclosure, such as a building).

In some implementations, the material for the interlocking panels may be provided in multiple colors, with different colors on opposing sides of each panel. As many of the interlocking panel designs disclosed herein are reversible, the interlocking panels may be assembled with a desired one of the two colors visible to a user using a workspace and a different color visible on the exterior of the interlocking panel system. In an example implementation, a first color is defined for handling a first food product (e.g., raw chicken), while a second color is defined for handling a second food product (e.g., raw beef). The colors enable a user to consistently use the correct side of the interlocking panel system assigned to type of food the user intends to prepare. The colors also allow a supervisor to quickly confirm that the user is using the correct side of the interlocking panel system assigned to the type of food the user is preparing.

The above specification and examples provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A workspace barrier comprising:

a first panel including a first finger joint defining an interfacing edge surface of the first panel, the first finger joint having a curved interlocking plan and an interlocking profile, the interlocking profile having a consistent s-shape across an entirety of the interfacing edge surface of the first panel; and a second panel including a second finger joint defining an interfacing edge surface of the second panel, the second finger joint also having a curved interlocking plan and an interlocking profile, the interlocking profile having a consistent s-shape across an entirety of the interfacing edge surface of the second panel, the interfacing edge surfaces occupying an entire contact area between the first panel and the second panel when assembled, wherein the first panel is slidably connectable to the second panel by interfacing the first finger joint with the second finger joint without separate fasteners, wherein the first finger joint interfaced with the second finger joint forms a splash-tight seal when the first panel is connected to the second panel, and wherein the first panel is held in place when connected to the second panel by force of gravity.

2. The workspace barrier of claim 1, wherein one or both of the first panel and the second panel are rectangular.

3. The workspace barrier of claim 1, wherein the interlocking plans of the first and second finger joints are s-shaped.

4. The workspace barrier of claim 1, wherein the first and the second finger joints have an identical structure.

5. The workspace barrier of claim 1, wherein the interlocking profiles of the first panel and the second panel are mirrored s-shaped interlocking profiles.

6. The workspace barrier of claim 1, wherein the first panel is removably connectable to the second panel.

7. The workspace barrier of claim 1, wherein the first panel is secured from movement relative to the second panel in all linear directions aside from one when connected to the second panel.

8. The workspace barrier of claim 1, wherein the first panel and the second panel share a common plane when the first panel is connected to the second panel.

9. A workspace barrier comprising:

a left-rear panel including a first finger joint defining an interfacing edge surface of the left-rear panel, the first finger joint having an interlocking plan and an interlocking profile, the interlocking profile having a consistent s-shape across an entirety of the interfacing edge surface of the left-rear panel;

a right-rear panel including a second finger joint defining an interfacing edge surface of the right-rear panel, the second finger joint also having an interlocking plan and an interlocking profile, the interlocking profile having a consistent s-shape across an entirety of the interfacing edge surface of the right-rear panel, the interfacing edge surfaces occupying an entire contact area between the left-rear panel and the right-rear panel when assembled, wherein the left-rear panel is slidably connectable to the right-rear panel by interfacing the first finger joint with the second finger joint without separate fasteners, wherein the first finger joint interfaced with the second finger joint forms a splash-tight seal when the left-rear panel is connected to the right-rear panel, and wherein the left-rear panel is held in place when connected to the right-rear panel by force of gravity;

a left panel selectively interlocked with the left-rear panel and extending in a different plane from the left-rear panel and the right-rear panel when assembled; and a right panel selectively interlocked with the right-rear panel and extending in another different plane from the left-rear panel and the right-rear panel when assembled.

10. The workspace barrier of claim 9, further comprising:

a work surface panel selectively interlocked with the left-rear panel, the right-rear panel, the left panel, and the right panel, the work surface panel extending in another different plane from the left-rear panel, the right-rear panel, the left panel, and the right panel, when assembled.

11. The workspace barrier of claim 9, wherein at least one of the left-rear panel, the right-rear panel, the left panel, and the right panel includes a slot functional as a carrying handle.

12. The workspace barrier of claim 9, wherein each of the left-rear panel, the right-rear panel, the left panel, and the right panel are made of high-density polyethylene (HDPE).

13. The workspace barrier of claim 9, wherein the left panel is selectively interlocked with the left-rear panel at a first D-tab and slot corner joint and the right panel is selectively interlocked with the right-rear panel at a second D-tab and slot joint.

14. The workspace barrier of claim 9, wherein the left-rear panel and the right-rear panel extend in a common planar direction, and wherein the left panel and the right panel each extend from the left-rear panel and the right-rear panel approximately 90 degrees from the common planar direction of the left-rear panel and the right-rear panel.

15. A method of assembling a workspace barrier comprising:

selectively interlocking a left-rear panel including a first finger joint defining an interfacing edge surface of the left-rear panel to a right-rear panel including a second finger joint defining an interfacing edge surface of the right-rear panel, each of the first finger joint and the second finger joint having a respective interlocking plan and a respective interlocking profile, the interlocking profiles having a consistent s-shape across an entirety of the interfacing edge surfaces of the left-rear panel and the right-rear panel, the interfacing edge surfaces occupying an entire contact area between the left-rear panel and the right-rear panel when assembled, wherein the left-rear panel is slidably connectable to the right-rear panel by interfacing the first finger joint with the second finger joint without separate fasteners, wherein the first finger joint interfaced with the second finger joint forms a splash-tight seal when the left-rear panel is connected to the right-rear panel, and wherein the left-rear panel is held in place when connected to the right-rear panel by force of gravity;

selectively interlocking a left panel to the left-rear panel, the left panel extending in a different plane from the left-rear panel and the right-rear panel;

selectively interlocking a right panel to the right-rear panel, the right panel extending in a different plane from the left-rear panel and the right-rear panel; and positioning the interlocked workspace barrier in a self-supporting vertical orientation upon a workspace.

16. The method of claim 15, wherein the left-rear panel and the right-rear panel extend in a common planar direction, and wherein the left panel and the right panel each extend from the left-rear panel and the right-rear panel approximately 90 degrees from the common planar direction of the left-rear panel and the right-rear panel.

* * * * *